US012221734B2

(12) United States Patent
Xu et al.

(10) Patent No.: US 12,221,734 B2
(45) Date of Patent: Feb. 11, 2025

(54) SUPPORT FRAME AND LAUNDRY PROCESSING DEVICE

(71) Applicant: WUXI LITTLE SWAN ELECTRIC CO., LTD., Wuxi (CN)

(72) Inventors: Yugao Xu, Wuxi (CN); Xuelong Hou, Wuxi (CN); Jianping Peng, Wuxi (CN); Jin Woo So, Wuxi (CN); Chunyu Zhu, Wuxi (CN); Wenfa Liu, Wuxi (CN); Lian Liang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 846 days.

(21) Appl. No.: 17/420,392

(22) PCT Filed: Apr. 28, 2019

(86) PCT No.: PCT/CN2019/084798
§ 371 (c)(1),
(2) Date: Jul. 2, 2021

(87) PCT Pub. No.: WO2020/140352
PCT Pub. Date: Jul. 9, 2020

(65) Prior Publication Data

US 2022/0081819 A1 Mar. 17, 2022

(30) Foreign Application Priority Data

Jan. 3, 2019 (CN) ..... 201910005456.X
Jan. 3, 2019 (CN) ..... 201920010370.1

(51) Int. Cl.
*D06F 29/00* (2006.01)
*D06F 39/12* (2006.01)

(52) U.S. Cl.
CPC ..... *D06F 29/005* (2013.01); *D06F 39/12* (2013.01)

(58) Field of Classification Search
CPC ..... D06F 29/005
See application file for complete search history.

(56) References Cited

U.S. PATENT DOCUMENTS

| | | | |
|---|---|---|---|
| 8,616,388 | B2 | 12/2013 | Butler et al. |
| 2008/0121600 | A1 | 5/2008 | Korte et al. |
| 2015/0101697 | A1 | 4/2015 | Duffy |

FOREIGN PATENT DOCUMENTS

| | | | |
|---|---|---|---|
| CN | 2136263 | Y | 6/1993 |
| CN | 103806251 | A | 5/2014 |
| CN | 203741597 | U | 7/2014 |
| CN | 207537778 | U | 6/2018 |
| CN | 108301176 | A | 7/2018 |
| CN | 208151704 | U | 11/2018 |
| CN | 208151705 | U | 11/2018 |
| CN | 208151725 | U | 11/2018 |
| DE | 112013007225 | T5 | 4/2016 |

(Continued)

OTHER PUBLICATIONS

International Search Report for PCT No. PCT/CN2019/084798.

(Continued)

*Primary Examiner* — Jason Y Ko
(74) *Attorney, Agent, or Firm* — Anova Law Group, PLLC

(57) ABSTRACT

A support frame and a laundry processing device are provided. The support frame includes a base, and a vertical beam extending upwards from the base. Vertical beams are provided, and at least part of the vertical beams are formed by detachably connecting at least two sub-units.

19 Claims, 23 Drawing Sheets

(56) References Cited

FOREIGN PATENT DOCUMENTS

| | | | |
|---|---|---|---|
| EP | 3124675 | A1 | 2/2017 |
| JP | H08215485 | A | 8/1996 |
| WO | 2004097098 | A1 | 11/2004 |

OTHER PUBLICATIONS

The European Patent Office (EPO) Extended Search Report for EP Application No. 19906936.0 Jul. 28, 2023 7 Pages.
Brazilian Patent and Trademark Office (INPI) The Search Report for BR Application No. 1120210131698 Feb. 9, 2023 7 Pages (Translation Included).

SUPPORT FRAME AND LAUNDRY PROCESSING DEVICE

CROSS-REFERENCES TO RELATED APPLICATIONS

The present disclosure is a national phase application of International Application No. PCT/CN2019/084798, filed on Apr. 28, 2019, which claims priority to Chinese Patent Application Serial Nos. 201910005456.X and No. 201920010370.1, filed on Jan. 3, 2019, the entire content of which are incorporated herein by reference.

FIELD

The present application relates to a field of laundry processing technologies, and more particularly to a support frame and a laundry processing device.

BACKGROUND

Most of frame structures in the related art are one-piece, which guarantees stability of the frames. When mounting a component with a large size, the frame itself may block the mounting of the component, and thus the component is hard to be assembled into the frame. As to this problem, the related art discloses a frame structure, which includes a base and a vertical beam located at a front side of the base and extending upwards above a drying tub. When assembled to the drying tub, a rear side of the base is provided with no vertical beam. Thus, during assembly, the vertical beam located at the front side cannot provide good fixing for the drying tub, and it is easy to shake, to affect assembly effect.

SUMMARY

Embodiments of the present disclosure seek to solve at least one of the problems existing in the related art. To this end, embodiments of the present application are to propose a support frame, which has a simple structure and high structural strength.

The present application further proposes a laundry processing device having the above-described support frame.

The support frame according to embodiments of the present application includes a base and a vertical beam extending upwards from the base. Vertical beams are provided, and at least part of the vertical beams is formed by detachably connecting at least two sub-units.

In the support frame according to embodiments of the present application, at least part of the vertical beams is formed by detachably connecting at least two sub-units. Thus, after the two sub-units are separated, a mounting space with a large opening is defined in the frame, facilitating assembly of components. For example, if the support frame is applied in the laundry processing device, a mounting space with a large opening can be defined in the support frame for mounting a laundry processing device. After completion of mounting the laundry processing device, the remaining sub-units are assembled. Furthermore, compared to a support frame in the related art, the present embodiment further enhances strength of the frame structure without affecting assembly of components to be mounted.

According to an embodiment of the present application, the base is formed into a square base, four vertical beams are provided, and the four vertical beams are formed to extend from four corners of the square base.

In some embodiments, two corners located at a side of the square base are provided with a first vertical beam and a second vertical beam respectively, and the first vertical beam and/or the second vertical beam are formed by detachably connecting at least two sub-units.

According to an embodiment of the present application, the first vertical beam is formed by detachably connecting two sub-units. The two sub-units of the first vertical beam are a first lower vertical beam extending upwards from the square base and a first upper vertical beam extending upwards from the first lower vertical beam, and the first upper vertical beam has a lower end detachably connected to an upper end of the first lower vertical beam.

According to another embodiment of the present application, the second vertical beam is formed by detachably connecting two sub-units. The two sub-units of the second vertical beam are a second lower vertical beam extending upwards from the square base and a second upper vertical beam extending upwards from the second lower vertical beam, and the second upper vertical beam has a lower end detachably connected to an upper end of the second lower vertical beam.

In some examples, the lower end of each of the first upper vertical beam and the second upper vertical beam is provided with a vertical beam connecting sheet extending downwards. The vertical beam connecting sheet of the first upper vertical beam is connected to the upper end of the first lower vertical beam by a fastener, and the vertical beam connecting sheet of the second upper vertical beam is connected to the upper end of the second lower vertical beam by a fastener.

In some examples, the vertical beam connecting sheet is bent outwards and extends downwards relative to the first upper vertical beam or the second upper vertical beam, and at least part of an outer side of the upper end of the first lower vertical beam or the second lower vertical beam is covered by the vertical beam connecting sheet.

According to an embodiment of the present application, the square base has a bottom plate and four side enclosure plates connected to sides of the bottom plate, and lower ends of two adjacent vertical beams are connected by the side enclosure plate.

According to an embodiment of the present application, the support frame further includes connecting cross beams, and middle portions of two adjacent vertical beams are connected by the connecting cross beam.

In some embodiments, two corners located at another side of the square base are provided with a third vertical beam and a fourth vertical beam respectively, middle portions of outer surfaces of the third vertical beam and the fourth vertical beam each define a recessed first accommodating recess; and two ends of at least one connecting cross beam are disposed in the first accommodating recesses of the third vertical beam and the fourth vertical beams respectively.

In some examples, a bottom wall of the first accommodating recess defines a snapping hole, the two ends of the connecting cross beam are each provided with a snapping tongue bent towards the vertical beam, and the snapping tongue is inserted downward into the snapping hole.

According to further embodiments of the present application, the support frame further includes a top connecting frame connected to the upper end of the vertical beam. At least part of the top connecting frame and one sub-unit of the vertical beam are integrally formed from a same plate using a bending forming process.

In some embodiments, the at least part of the top connecting frame is formed by bending one sub-unit of the first vertical beam and/or the second vertical beam.

In some embodiments, two corners located at another side of the square base are provided with a third vertical beam and a fourth vertical beam respectively, an upper end of at least one of the third vertical beam and the fourth vertical beam defines a notch recessed downwards, the top connecting frame has an insertion sheet bent outwards, and the insertion sheet is inserted in the notch.

In some embodiments, the upper end of at least one of the third vertical beam and the fourth vertical beam has a first connecting sheet and a second connecting sheet arranged at a preset angle, and the top connecting frame has a first connecting flange and a second connecting flange extending downwards and arranged at a preset angle. The first connecting flange and the second connecting flange are spaced apart, the first connecting sheet is disposed at an outer side of the first connecting flange, and the second connecting sheet is inserted through a gap between the first connecting flange and the second connecting flange to be disposed at an inner side of the second connecting flange.

In some examples, the notch is defined in the first connecting sheet, and the insertion sheet is provided to the first connecting flange.

In some examples, the first connecting sheet defines a first perforation, and the first connecting flange defines a through hole corresponding in position to the first perforation. The first connecting sheet and the first connecting flange are connected by a fastener passing through the first perforation and the first through hole.

In some examples, the second connecting sheet defines a second perforation, and the second connecting flange defines a second through hole corresponding in position to the second perforation. The second connecting sheet and the second connecting flange are connected by a fastener passing through the second perforation and the second through hole.

The laundry processing device according to embodiments of the present application includes a first laundry processing device, a second laundry processing device, and a support frame according to the above-described embodiments. The support frame defines therein a first accommodating space for assembly of the first laundry processing device and a second accommodating space for assembly of the second laundry processing device.

Additional embodiments of the present application will be given in part in the following descriptions, become apparent in part from the following descriptions, or be learned from the practice of the present application.

BRIEF DESCRIPTION OF THE DRAWINGS

These and other embodiments of the present application will become apparent and more readily appreciated from the following descriptions made with reference to the drawings, in which.

Figure 1:
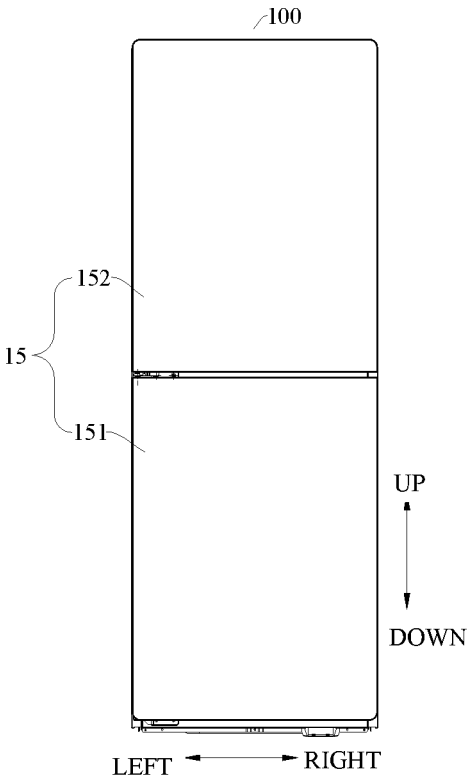
FIG. 1 is a front view of a laundry processing device according to an embodiment of the present application.
Figure 2:
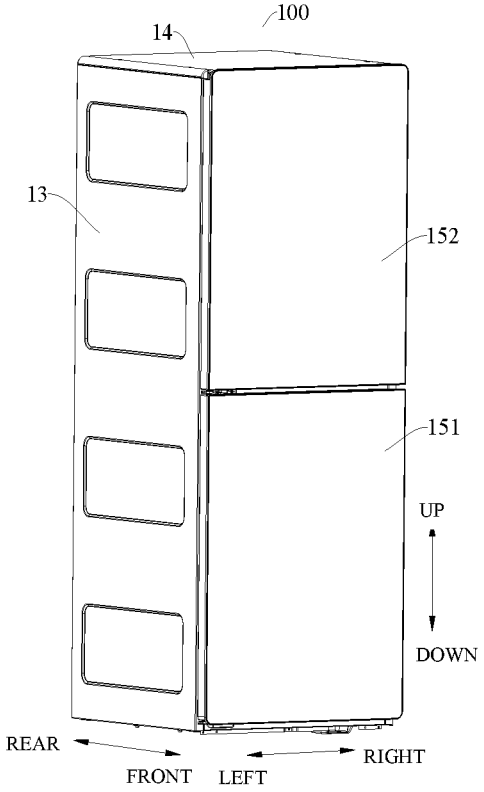
FIG. 2 is a perspective view of a laundry processing device according to an embodiment of the present application.
Figure 3:
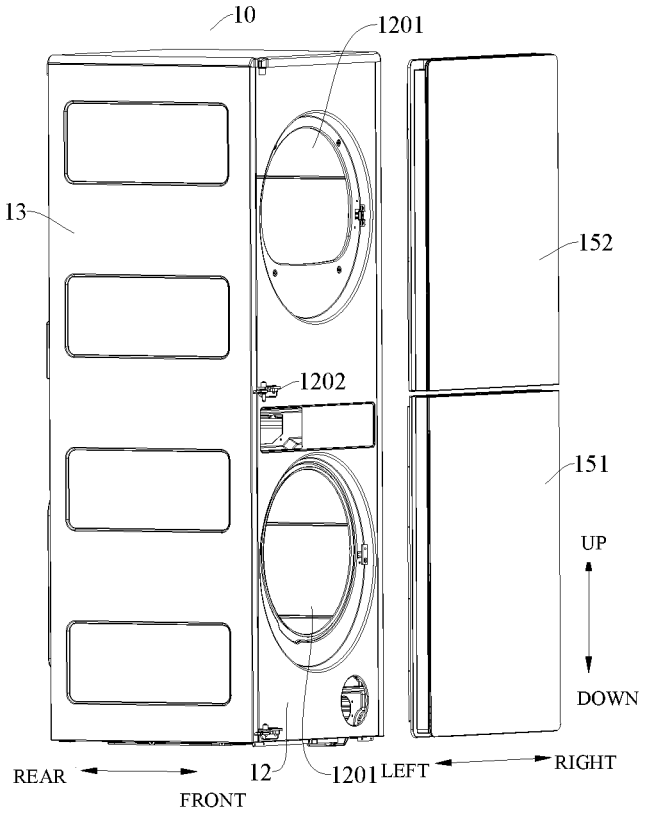
FIG. 3 is a structural schematic view of a cabinet of a laundry processing device according to an embodiment of the present application.
Figure 4:
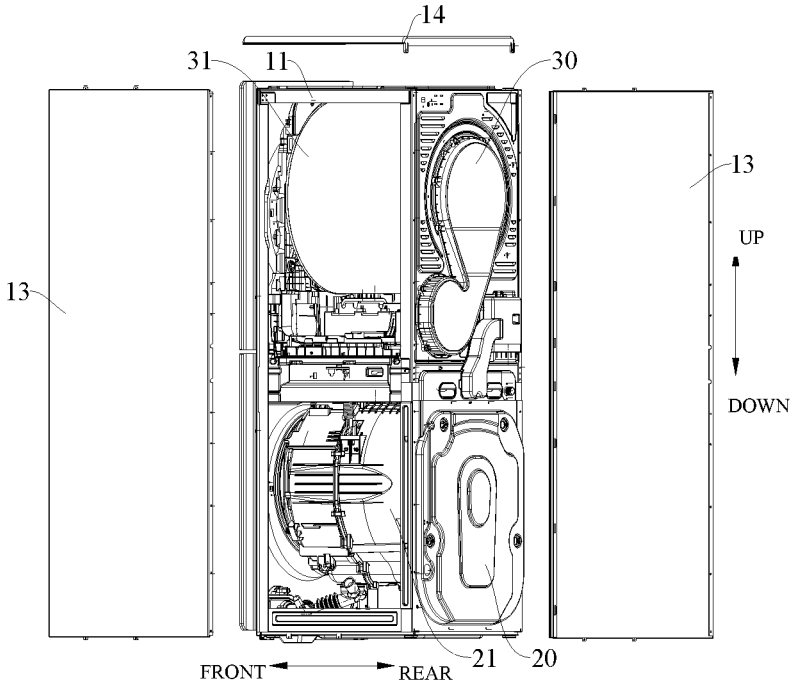
FIG. 4 is an exploded view of a structure illustrated in FIG. 3.

REFERENCE NUMERALS laundry processing device 100;

cabinet 10;

support frame 11; first accommodating space 1101; second accommodating space 1102; frame connecting hole 1104; frame perforation 1105; frame positioning hole 1106;

base 111; bottom plate 1111; side enclosure plate 1112; second hinge mounting seat 1113 (1184);

third vertical beam 112;

fourth vertical beam 113; first accommodating recess 1131; snapping hole 11311; second accommodating recess 1132; first fixing perforation 11321; second fixing perforation 11322; first connecting sheet 1133; notch 11331; first perforation 11332; second connecting sheet 1134; second perforation 11341;

second vertical beam 114; second lower vertical beam 1141; second upper vertical beam 1142; vertical beam connecting sheet 11421;

first vertical beam 115; first lower vertical beam 1151; first upper vertical beam 1152;

connecting cross beam 117; snapping tongue 1171; first hinge mounting seat 1172;

top connecting frame 118; first connecting flange 1182; insertion sheet 11821; first through hole 11822; second connecting flange 1183; second through hole 11831;

front panel 12; opening 1201; mounting recess 1202;

panel mounting portion 121; panel connecting hole 1211; panel perforation 1212; panel positioning hole 1213;

panel connecting member 122, panel connecting portion 1221, connecting perforation 12211, connecting post 1222, leg 12221, positioning post 1223, connecting protrusion 1224, groove 1225;

side panel 13, panel covering portion 131, snapping slot 1311, top panel 14;

door assembly 15;

first door 151; second door 152; mounting cavity 1520; mounting opening 1521; cover plate 1522; control panel 1523;

intermediate hinge 153; intermediate mounting portion 1531, intermediate connecting portion 1532, upper fixing shaft 1533; lower fixing shaft 1534;

first end hinge 154, first end face mounting portion 1541; first end face connecting portion 1542; lower connecting shaft 1543;

second end hinge 155, second end face mounting portion 1551; second end face connecting portion 1552; upper connecting shaft 1553;

first laundry processing device 20; first laundry processing tub 21;

second laundry processing device 30; second laundry processing tub 311; laundry access port 311;

support structure 312; second connecting hole 3121;

frame connecting member 313; first connecting hole 3131; first fixing protrusion 3132; second fixing protrusion 3133; connecting body 3134; connecting arm 3135;

seat 32; suction area 321; blower mounting cavity 322; heat pump mounting cavity 323;

reinforcing plate 33; raised ring 3301; first plate portion 331; first vent hole 3311; reinforcing recess 3313; second plate portion 332; second vent hole 3321; reinforcing protrusion 3323; mounting boss 3324; mounting hole 3325; fixing flange 333; fixing hole 3331; insertion hole 3332; first mounting flange 334; second mounting flange 335; avoidance notch 336.

DETAILED DESCRIPTION OF THE DISCLOSURE

Embodiments of the present application will be described in detail and examples of the embodiments will be illustrated in the drawings, where same or similar reference numerals are used to indicate same or similar members or members with same or similar functions. The embodiments described herein with reference to drawings are explanatory, illustrative, and only used to generally understand the present application. The embodiments shall not be construed to limit the present application.

A laundry processing device 100 according to embodiments of the present application will be described in the following with reference to FIGS. 1 to 42.

As illustrated in FIGS. 1 to 12, a support frame 11 according to embodiments of the present application includes a base 111 and a vertical beam. The vertical beam extends upwards from the base 111. Vertical beams are provided, and at least part of the vertical beams is formed by detachably connecting at least two sub-units.

In the support frame 11 according to embodiments of the present application, at least part of the vertical beams is formed by detachably connecting at least two sub-units. Thus, after the two sub-units are separated, an unobstructed large mounting space is defined, facilitating mounting of components. For example, if the support frame 11 is applied in the laundry processing device 100, a large mounting space for mounting a laundry processing device can be defined by the support frame 11 after the sub-units of the vertical beam are separated. After completion of mounting the laundry processing device, the remaining sub-units are assembled, facilitating assembly. Furthermore, compared to a support frame 11 in the related art, the present embodiment further enhances strength of the support frame 11 without affecting mounting of components.

According to an embodiment of the present application, the base 111 is formed into a square base 111. Four vertical beams are provided, i.e. a first vertical beam 115, a second vertical beam 114, a third vertical beam 112 and a fourth vertical beam 113. The four vertical beams are formed to extend from four corners of the square base 111, and the four vertical beams are utilized to define an accommodating space between them.

In some embodiments, two corners located at a side of the square base 111 are provided with the first vertical beam 115 and the second vertical beam 114 respectively, and the first vertical beam 115 and/or the second vertical beam 114 are formed by detachably connecting at least two sub-units. That is, one of the first vertical beam 115 and the second vertical beam 114 is formed by detachably connecting at least two sub-units; or each of the first vertical beam 115 and the second vertical beam 114 is formed by detachably connecting at least two sub-units.

According to an embodiment of the present application, the first vertical beam 115 is formed by detachably connecting two sub-units. The two sub-units of the first vertical beam 111 are a first lower vertical beam 1151 and a first upper vertical beam 1152 respectively. The first lower vertical beam 1151 extends upwards from the square base 111, the first upper vertical beam 1152 extends upwards from the first lower vertical beam 1151, and the first upper vertical beam 1152 has a lower end detachably connected to an upper end of the first lower vertical beam 1151.

In one embodiment, as illustrated in FIGS. 5 to 9, the vertical beams include two short vertical beams and three long vertical beams. The two short vertical beams and the three long vertical beams all extend in an up-and-down direction. Lower ends of one short vertical beam and the three long vertical beams are connected to four corners of the square base 111 respectively, and the short vertical beam and lower portions of the three long vertical beams are utilized to define a first accommodating space 1101 located at a lower portion. The short vertical beam has a small height, thus it will not has an interference effect during mounting upper components. That is, a large mounting space is defined between the fourth vertical beam 113 and the second vertical beam 114, and upper components can be easily assembled into a second accommodating space 1102 through the mounting space. After assembly of the component is completed, the lower end of the second short vertical beam is connected to the upper end of the first short vertical beam, greatly improving assembly efficiency and structural stability.

According to another embodiment of the present application, the second vertical beam 114 is formed by detachably connecting two sub-units. The two sub-units of the second vertical beam 114 are a second lower vertical beam 1141 extending upwards from the square base 111 and a second upper vertical beam 1142 extending upwards from the second lower vertical beam 1141, respectively. A lower end of the second upper vertical beam 1142 is detachably connected to an upper end of the second lower vertical beam 1141.

Figure 10:
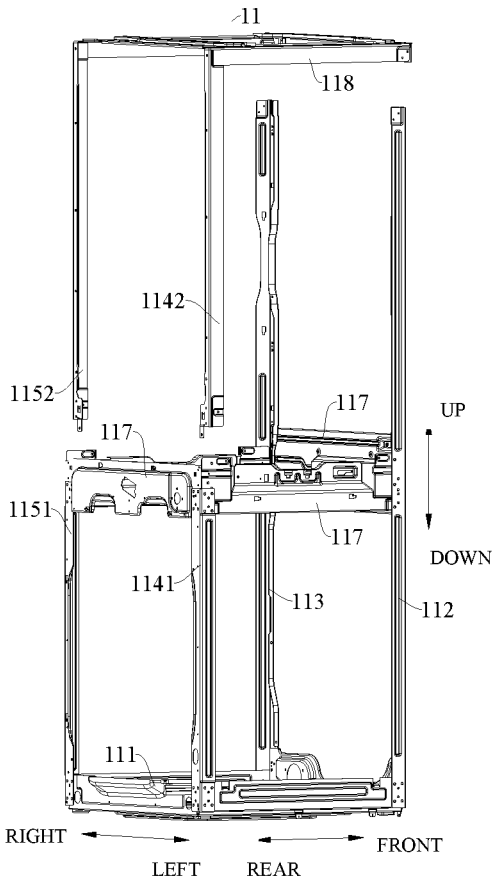
FIG. 10 is an exploded view of a support frame of a laundry processing device according to another embodiment of the present application.
Figure 11:
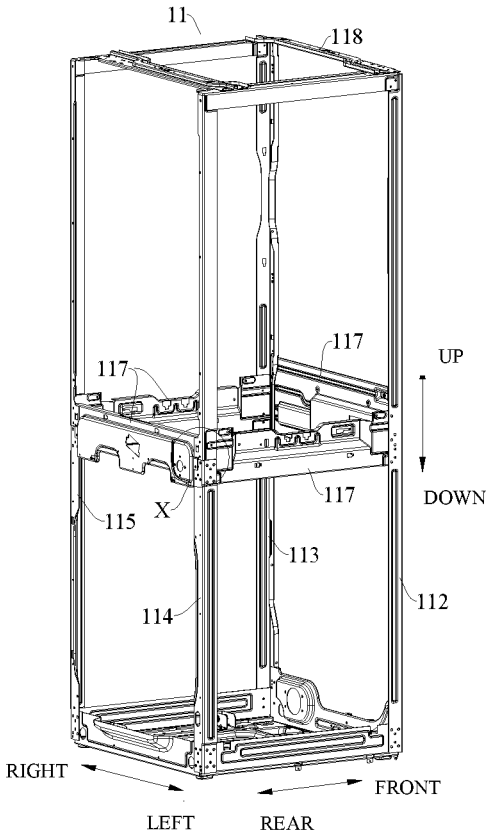
FIG. 11 is an assembly diagram of the support frame illustrated in FIG. 10.
Figure 12:
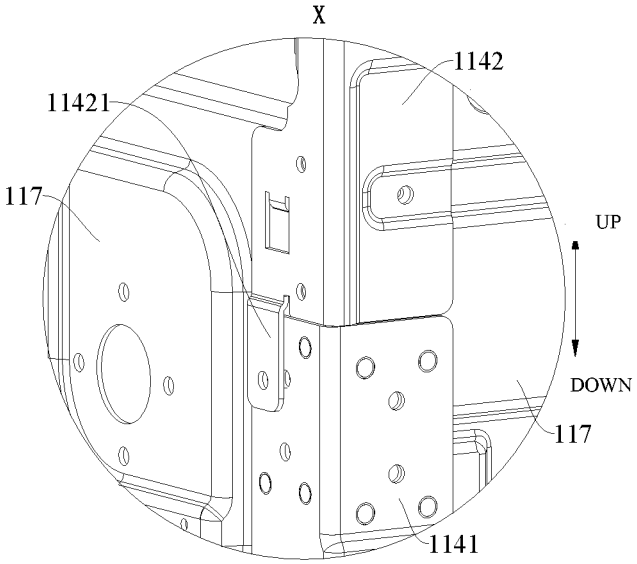
FIG. 12 is an enlarged view of portion X illustrated in FIG. 11.

In one embodiment, as illustrated in FIGS. 10 to 12, the vertical beams include four short vertical beams and two long vertical beams. The four short vertical beams and the two long vertical beams all extend in the up-and-down direction. Lower ends of two short vertical beams and the two long vertical beams are connected to the four corners of the square base 111, and the two short vertical beams and lower portions of the two long vertical beams define a first accommodating space 1101 located at a lower portion. When first upper vertical beam is separated from the first lower vertical beam, and the second upper vertical beam is separated from the second lower vertical beam, a large mounting space is defined in an upper portion of the frame. That is, a wide range of mounting space is defined behind the third vertical beam and the fourth vertical beam, and a laundry processing device can be conveniently passed through the mounting space and assembled into the support frame 11. After completion of assembly of the component, the lower ends of the two short vertical beams are connected to the upper ends of the two short vertical beams, greatly improving assembly efficiency and structural stability. Thus, the present embodiment can make the laundry processing device be assembled into the second accommodating space 1102 more conveniently.

In some examples, the lower end of the first upper vertical beam 1152 is provided with a vertical beam connecting sheet 11421 extending downwards, and the vertical beam connecting sheet 11421 of the first upper vertical beam 1152 is connected to the upper end of the first lower vertical beam 1151 by a fastener. The lower end of the second upper vertical beam 1142 is provided with a vertical beam connecting sheet 11421 extending downwards, and the vertical beam connecting sheet 11421 of the second upper vertical beam 1142 is connected to the upper end of the second lower vertical beam 1141 by a fastener. For example, the vertical beam connecting sheet 11421 defines a perforation adapted for passage of the fastener, facilitating connection.

In some examples, the vertical beam connecting sheet 11421 of the first upper vertical beam 1152 is bent outwards and extends downwards relative to the first upper vertical beam 1152, and at least part of an outer side of the upper end of the first lower vertical beam 1151 is covered by the vertical beam connecting sheet 11421. The vertical beam connecting sheet 11421 of the second upper vertical beam 1142 is bent outwards and extends downwards relative to the second upper vertical beam 1142, and at least part of an outer side of the upper end of the second lower vertical beam 1141 is covered by the vertical beam connecting sheet 11421. This not only facilitates the connection, but also ensures the connection reliability and stability between them.

According to an embodiment of the present application, the square base 111 has a bottom plate 1111 and four side enclosure plates 1112 connected to sides of the bottom plate 1111. Lower ends of two adjacent vertical beams are connected by the side enclosure plate 1112, to ensure connection reliability and structural stability of the support frame 11.

According to an embodiment of the present application, the support frame 11 further includes connecting cross beams 117. Middle portions of two adjacent vertical beams are connected by the connecting cross beam 117, to further ensure connection reliability and structural stability of the support frame 11.

In some embodiments, two corners located at another side of the square base 111 are provided with a third vertical beam 112 and a fourth vertical beam 113 respectively. Middle portions of outer surfaces of the third vertical beam 112 and the fourth vertical beam 113 each define a recessed first accommodating recess 1131, and two ends of at least one connecting cross beam 117 are disposed in the first accommodating recesses 1131 of the third vertical beam 112 and the fourth vertical beam 113, respectively, to prevent the connecting cross beam 117 from occupying excessive space and also to achieve positioning and mounting, which facilitates improvement of assembly efficiency of the support frame 11. Meanwhile, the design of the first accommodating recess 1131 also enhances strength of the vertical beam, and reduces its deformation and damage.

Figure 5:
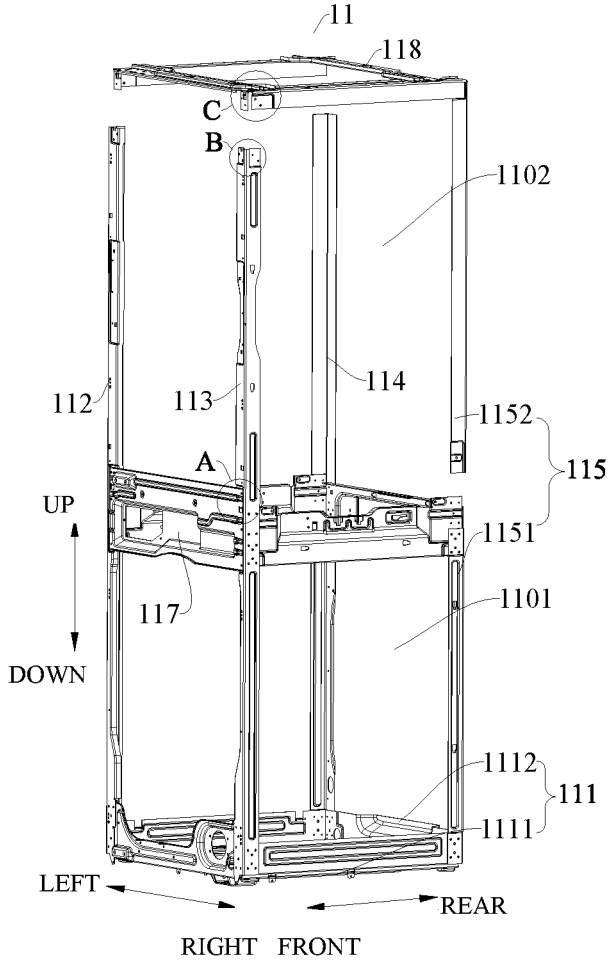
FIG. 5 is an exploded view of a support frame of a laundry processing device according to an embodiment of the present application.
Figure 6:
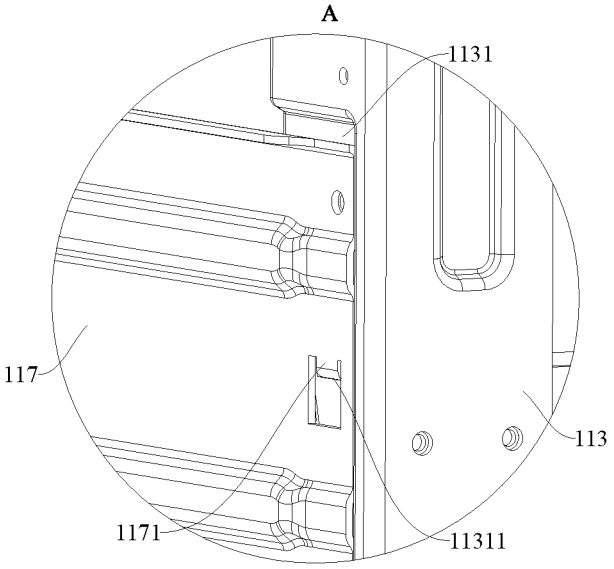
FIG. 6 is an enlarged view of portion A illustrated in FIG. 5.

In some examples, a bottom wall of the first accommodating recess 1131 defines a snapping hole 11311, and two ends of the connecting cross beam 117 are each provided with a snapping tongue 1171. The snapping tongue 1171 is bent towards the vertical beam (bent rearwards as illustrated in FIGS. 5 and 6), and the snapping tongue 1171 is inserted downwards into the snapping hole 11311, to mount the connecting cross beam 117 to the third vertical beam 112 and the fourth vertical beam 113. In some specific examples, the snapping tongue 1171 may have a hook shape, to hang the connecting cross beam 117 on the two vertical beams.

According to further embodiments of the present application, the support frame 11 further includes a top connecting frame 118. The top connecting frame 118 is connected to the upper end of the vertical beam. At least part of the top connecting frame 118 is integrally formed with one sub-unit of the vertical beam from the same plate using a bending forming process.

Referring to FIGS. 5 and 10, the top connecting frame 118 is connected to the upper end of each of the first upper vertical beam 1152, the second upper vertical beam 1142, the third vertical beam 112 and the fourth vertical beam 113.

It could be understood that, the at least part of the top connecting frame 118 is formed by bending one sub-unit of the first vertical beam 115 and/or the second vertical beam 114.

In one embodiment, in an example illustrated in FIG. 5, a cross beam of the top connecting frame 118 extending in a front-and-rear direction is integrally formed with the first upper vertical beam 1152 from the same plate by using a bending forming process. Before the first upper vertical beam 1152 is connected to the first lower vertical beam 1151, a mounting space having a large opening is defined by upper portions of the third vertical beam 112, the fourth vertical beam 113 and the second vertical beam 114, and a component to be assembled can be conveniently mounted in the second accommodating space 1102. After completion of assembly, the first upper vertical beam 1152 which is connected with the top connecting frame 118 is connected to the first lower vertical beam 1151. The operation is simple, facilitating improvement of the assembly efficiency.

In an example illustrated in FIG. 10, a cross beams of the top connecting frame 118 extending in the front-and-rear direction and located at a right side is integrally formed with the first upper vertical beam 1152 from the same plate by using a bending forming process, and a cross beam of the top connecting frame 118 extending in the front-and-rear direction and located at a left side is integrally formed with the second upper vertical beam 1142 from the same plate by using a bending forming process. Before the first upper vertical beam 1152 is connected to the first lower vertical beam 1151 and the second upper vertical beam 1142 is connected to the second lower vertical beam 1141, only the third vertical beam 112, the fourth vertical beam 113 and the four connecting cross beams 117 are relied on to provide support for the component to be assembled. As this is not a closed structure and will not interfere with or block the component to be assembled during assembly, the mounting of the component to be assembled is further facilitated. After completion of assembly, the first upper vertical beam 1152 and the second upper vertical beam 1142, which are connected with the top connecting frame 118, are connected to the first lower vertical beam 1151 and the second lower vertical beam 1141, respectively. The operation is simple, facilitating improvement of assembly efficiency.

In some embodiments, two corners located at another side of the square base 111 are provided with a third vertical beam 112 and a fourth vertical beam 113, respectively. The upper end of at least one of the third vertical beam 112 and the fourth vertical beam 113 defines a notch 11331 recessed downwards, the top connecting frame 118 has an insertion sheet 11821 bent outwards, and the insertion sheet 11821 is inserted in the notch 11331.

Figure 7:
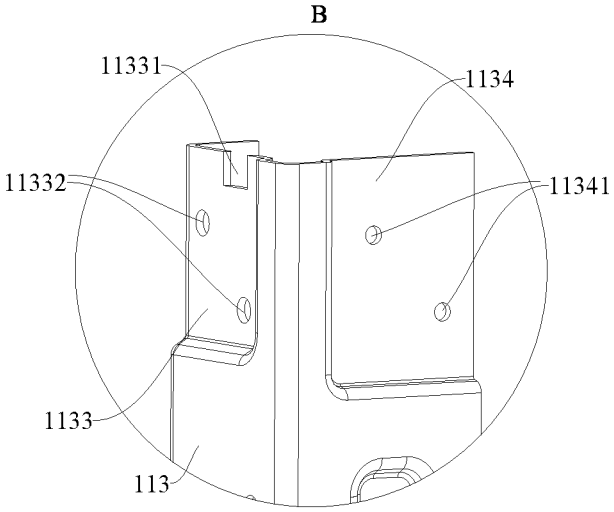
FIG. 7 is an enlarged view of portion B illustrated in FIG. 5.
Figure 8:
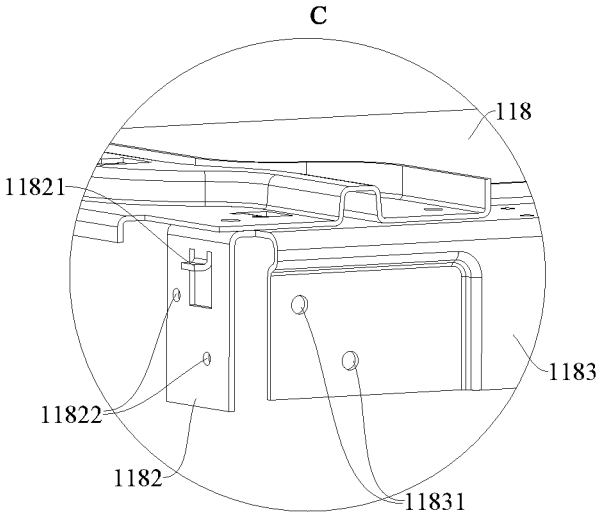
FIG. 8 is an enlarged view of portion C illustrated in FIG. 5.

In one embodiment, as illustrated in FIGS. 5 and 7-8, the upper end of the fourth vertical beam 113 defines a notch 11331 recessed downwards, and correspondingly, the corner of the top connecting frame 118 located at the front right has an insertion sheet 11821 bent outwards. The corner of the top connecting frame 118 located at the front right is snap-fitted with the upper end of the fourth vertical beam 113 through fit between the insertion sheet 11821 and the notch 11331. Furthermore, the upper end of the third vertical beam 112 is also snap-fitted with the corner of the top connecting frame 118 located at the front left through fit between the insertion sheet 11821 and the notch 11331. The connection is reliable and stable.

In some embodiments, the upper end of at least one of the third vertical beam 112 and the fourth vertical beam 113 has a first connecting sheet 1133 and a second connecting sheet 1134 arranged at a preset angle. The top connecting frame 118 has a first connecting flange 1182 and a second connecting flange 1183 that extend downwards, and the first connecting flange 1182 and the second connecting flange 1183 are arranged at a preset angle. The aforementioned preset angle may be 90 degrees, and so on.

As illustrated in FIGS. 7 and 8, the upper end of the fourth vertical beam 113 has the first connecting sheet 1133 and the second connecting sheet 1134, and the corner of the top connecting frame 118 located at the front right has the first connecting flange 1182 and the second connecting flange 1183. The first connecting flange 1182 is spaced apart from second connecting flange 1183. The first connecting sheet 1133 is disposed at an outer side of the connecting flange 1182. The second connecting sheet 1134 is inserted through a gap between the first connecting flange 1182 and the second connecting flange 1183, to be disposed at an inner side of the second connecting flange 1183, and the fourth vertical beam 113 and the top connecting frame 118 are further snap-fitted, and connection reliability and stability between them are further ensured.

In some examples, the notch 11331 is defined in the first connecting sheet 1133, and the insertion sheet 11821 is provided to the first connecting flange 1182. That is, connection reliability and stability of the top connecting frame 118 and the first vertical beam 115 can be ensured by interactions between the first connecting sheet 1133 and the first connecting flange 1182, between the second connecting sheet 1134 and the second connecting flange 1183, and between the notch 11331 and the insertion sheet 11821.

In some specific examples, the first connecting sheet 1133 defines a first perforation 11332, and the first connecting flange 1182 defines a first through hole 11822. The first through hole 11822 corresponds in position to the first perforation 11332, and the number of the first perforations 11332 is equal to the number of the first through holes 11822. The first connecting sheet 1133 and the first connecting flange 1182 are connected by a fastener passing through the first perforation 11332 and the first through hole 11822, to further ensure the connection reliability and stability of the top connecting frame 118 and the long vertical beam.

In some specific examples, the second connecting sheet 1134 defines a second perforation 11341, and the second connecting flange 1183 defines a second through hole 11831. The second through hole 11831 corresponds in position to the second perforation 11341, and the number of the second through holes 11831 is equal to the number of the second perforations 11341. The second connecting sheet 1134 and the second connecting flange 1183 are connected by a fastener passing through the second perforation 11341 and the second through hole 11831, to further ensure the connection reliability and stability of the top connecting frame 118 and the long vertical beam.

The laundry processing device 100 according to embodiments of the present application includes a first laundry processing device 20, a second laundry processing device 30 and a support frame 11 according to the above embodiments. The support frame 11 defines therein a first accommodating space 1101 for placement of the first laundry processing device 20 and a second accommodating space 1102 for placement of the second laundry processing device 30.

In the laundry processing device 100 according to embodiments of the present application, by employing the above-described support frame 11, a large mounting space can be defined, and the second laundry processing device 30 can be conveniently assembled in the second accommodating space 1102. After completion of assembly of the second laundry processing device 30, the remaining sub-units are then assembled. The assembly is convenient which facilitates improvement of assembly efficiency. The number of the components can be reduced to save redundant connectors, and improvement of structural strength of the support frame 11 can be facilitated.

In combination with FIGS. 1 to 42, a specific embodiment of the laundry processing device 100 according to the present application will be described in detail below.

As illustrated in FIGS. 1 to 4, the laundry processing device 100 includes a cabinet 10, a door assembly 15, a first laundry processing device 20 and a second laundry processing device 30.

The cabinet 10 serves as a frame structure of the laundry processing device 100. The cabinet 10 includes a support frame 11. The support frame 11 includes a square base 111, connecting cross beams 117, a top connecting frame 118, and four vertical beams, i.e. a first vertical beam 115, a second vertical beam 114, a third vertical beam 112 and a fourth vertical beam 113. The four vertical beams extend upwards from four corners of the square base 111, respectively. The first vertical beam 115 and the second vertical beam 114 are disposed at two corners of the square base 111 located at a rear portion, and the third vertical beam 112 and the fourth vertical beam 113 are located at two corners of the square base 111 located at a front portion.

The square base 111 includes a bottom plate 1111 and four side enclosure plates 1112 disposed around sides of a seat 32. Lower ends of two adjacent vertical beams are connected by the side enclosure plate 1112. Middle portions of two adjacent vertical beams are connected by the connecting cross beam 117. The upper end of each vertical beam is connected to the four corners of the top connecting frame 118.

A first accommodating space 1101 is defined between the top connecting frame 118, the plurality of connecting cross beams 117 and lower portions of the four vertical beams for assembly of the first laundry processing device 20. A second accommodating space 1102 is defined between the top connecting frame 118, the plurality of connecting cross beams 117 and upper portions of the four vertical beams for assembly of the second laundry processing device 30.

As illustrated in FIGS. 5 to 9, in some examples, the first vertical beam 115 includes two short vertical beams, i.e. a first lower vertical beam 1151 extending upwards from the square base 111 and a first upper vertical beam 1152 extending upwards from the first lower vertical beam 1151. The first upper vertical beam 1152 is integrally formed with a cross beam of the top connecting frame 118 extending in the front-and-rear direction and located at the right side from the same plate by using a bening forming process. That is, in the present embodiment, the first upper vertical beam 1152 and a portion of the top connecting frame 118 are integrally formed, and they do not need to be connected by a connection structure. A lower end of the first upper vertical beam 1152 is detachably connected to an upper end of the first lower vertical beam 1151, and to the connecting cross beam 117. Each of the second vertical beam 114, the third vertical beam 112 and the fourth vertical beam 113 is a long vertical beam.

Before assembly of the second laundry processing device 30, the first lower vertical beam 1151, the second vertical beam 114, the third vertical beam 112 and the fourth vertical beam 113 are assembled by the square base 111 and the plurality of connecting cross beams 117, and upper portions of the second vertical beam 114, the third vertical beam 112 and the fourth vertical beam 113 define an unobstructed large mounting space to facilitate assembly of the second laundry processing device 30. After completion of the assembly, the first upper vertical beam 1152, which is connected with the top connecting frame 118, is connected to the first lower vertical beam 1151.

As illustrated in FIGS. 10 to 12, in some other examples, the first vertical beam 115 and the second vertical beam 114 each includes two short vertical beams. That is, the first vertical beam 115 includes a first lower vertical beam 1151 extending upwards from the square base 111 and a first upper vertical beam 1152 extending upwards from the first lower vertical beam 1151, and the second vertical beam 114 includes a second lower vertical beam 1141 extending upwards from the square base 111 and a second upper vertical beam 1142 extending upwards from the second lower vertical beam 1141.

A cross beam of the top connecting frame 118 extending in the front-and-rear direction and located at the right side is integrally formed with the first upper vertical beam 1152 from the same plate using a bending forming process, and a cross beam of the top connecting frame 118 extending in the front-and-rear direction and located at the left side is integrally formed with the second upper vertical beam 1142 from the same plate using a bending forming process. That is, in the present embodiment, the first upper vertical beam 1152 and a portion of the top connecting frame 118 are integrally formed, the second upper vertical beam 1142 and another portion of the top connecting frame 118 are integrally formed, and they do not need to be connected by a connection structure. The lower end of the first upper vertical beam 1152 is detachably connected to the upper end of the first lower vertical beam 1151 and they are connected to the connecting cross beam 117 separately. The lower end of the second upper vertical beam 1142 is connected to the upper end of the second lower vertical beam 1141 and they are connected to the connecting cross beam 117 separately. Each of the third vertical beam 112 and the fourth vertical beam 113 is a long vertical beam.

Before assembly of the second laundry processing device 30, the first lower vertical beam 1151, the second lower vertical beam 1141, the third vertical beam 112 and the fourth vertical beam 113 are assembled by the square base 111 and the plurality of connecting cross beams 117, then the second laundry processing device 30 is assembled with the third vertical beam 112, the fourth vertical beam 113 and the connecting cross beams 117, and finally, the first upper vertical beam 1152 and the second upper vertical beam 1142, which are connected with the top connecting frame 118, are connected to the first lower vertical beam 1151 and the second lower vertical beam 1141, respectively.

As regard to connection manner between the upper vertical beam and the lower vertical beam, it will be described below by taking the second upper vertical beam 1142 and the second lower vertical beam 1141 as an example. As illustrated in FIGS. 11 and 12, the lower end of the second upper vertical beam 1142 is provided with a vertical beam connecting sheet 11421 extending downwards. The vertical beam connecting sheet 11421 of the second upper vertical beam 1142 is bent outwards and extends downwards relative to the second upper vertical beam 1142, and at least part of an outer side of the upper end of the second lower vertical beam 1141 is covered by the vertical beam connecting sheet 11421. The vertical beam connecting sheet 11421 of the second upper vertical beam 1142 is connected to the upper end of the second lower vertical beam 1141 by a fastener. The connection is convenient, and the connection reliability and stability of them are ensured.

As regard to connection manner between the vertical beam and the connecting cross beam 117, it will be described below by taking the third vertical beam 112 and the fourth vertical beam 113 as an example. As illustrated in FIGS. 5 and 6, middle portions of front side surfaces of the third vertical beam 112 and the fourth vertical beam 113 each define a recessed first accommodating recess 1131. A bottom wall of each first accommodating recess 1131 defines a snapping hole 11311. Two ends of the connecting cross beam 117 are each provided with a snapping tongue 1171 bent downwards. The two ends of the connecting cross beam 117 are disposed in the first accommodating recesses 1131 of the third vertical beam 112 and the fourth vertical beam 113, respectively, and the snapping tongue 1171 is inserted downwards into the snapping hole 11311, to mount the connecting cross beam 117 to the third vertical beam 112 and the fourth vertical beam 113.

As regard to connection manner between the vertical beam and the top connecting frame 118, it will be described below by taking the fourth vertical beam 113 as an example. As illustrated in FIGS. 5, 7 and 8, the upper end of the fourth vertical beam 113 has a first connecting sheet 1133 and a second connecting sheet 1134 arranged at an angle of 90 degrees. The first connecting sheet 1133 defines a notch 11331 and a first perforation 11332, and the second connecting sheet 1134 defines a second perforation 11341. A corner of the top connecting frame 118 corresponding in position to the fourth vertical beam 113 is provided with a first connecting flange 1182 and a second connecting flange 1183 that extend downwards. The first connecting flange 1182 is spaced apart from the second connecting flange 1183. The first connecting flange 1182 is provided with an insertion sheet 11821 bent outwards and a first through hole 11822, and the second connecting flange 1183 defines a second through hole 11831.

When assembling, the first connecting sheet 1133 is disposed at an outer side of the first connecting flange 1182, the second connecting sheet 1134 is inserted through a gap between the first connecting flange 1182 and the second connecting flange 1183, and the insertion sheet 11821 is fitted in the notch 11331. The first connecting sheet 1133 and the first connecting flange 1182 are connected by a fastener passing through the first perforation 11332 and the first through hole 11822, and the second connecting sheet 1134 and the second connecting flange 1183 are connected by a fastener passing through the second perforation 11341 and the second through hole 11831, to ensure connection reliability and stability of the top connecting frame 118 and the fourth vertical beam 113.

As illustrated in FIGS. 32 to 42, the frame structure further includes panels, i.e. a front panel 12, two side panels 13, a back panel and a top panel 14. The front panel 12 covers a front region of the support frame 11, and the front panel 12 defines two openings 1201 spaced in the up-and-down direction. Positions of the two openings 1201 correspond to positions of laundry access ports 311 of the first laundry processing device 20 and the second laundry processing device 30. The back panel covers a rear region of the support frame 11, and the two side panels 13 cover a left region and a right region of the support frame 11.

The connection manner of the front panel 12, the side panel 13 located at the left side and the support frame 11 will be described in detail below. The third vertical beam 112 is disposed at a corner of the square base 111 located at the front left. A front side surface of the third vertical beam 112 defines a frame connecting hole 1104, a frame positioning hole 1106, and a frame perforation 1105. A left side of the front panel 12 has a panel mounting portion 121 recessed relative to an outer surface of the front panel 12. The panel mounting portion 121 defines a panel connecting hole 1211 corresponding in position to the frame connecting hole 1104, a panel positioning hole 1213 corresponding in position to the frame positioning hole 1106, and a panel perforation 1212 corresponding in position to the frame perforation 1105. A front side of the side panel 13 located at the left side has a panel covering portion 131 bent towards the front panel 12, and an inner side of the panel covering portion 131 defines a snapping slot 11311.

The panel mounting portion 121 is connected to the third vertical beam 112 by a panel connecting member 122 passing through the panel connecting hole 1211 and the frame connecting hole 1104. The panel connecting member 122 includes a panel connecting portion 1221, a positioning post 1223 and a connecting post 1222. The panel connecting portion 1221 is provided with a connecting protrusion 1224 to define a groove 1225 recessed downwards. The connecting post 1222 includes two legs 12221 that are spaced apart.

When assembling, the panel mounting portion 121 of the front panel 12 can be fixed to the third vertical beam 112 by a screw, then the two legs 12221 of the panel connecting member 122 are squeezed to allow the connecting post 1222 to pass through the panel connecting hole 1211 and the frame connecting hole 114 sequentially, and the two legs 12221 are released to achieve an anti-separation effect. Furthermore, the positioning post 1223 is passed through the frame positioning hole 1206 and the panel positioning hole 1213, and a fastener is passed through the connecting perforation 12211, the panel perforation 1212 and the frame perforation 1105 to further ensure connection reliability of the panel connecting member 122, the panel mounting portion 121 and the third vertical beam 112. Finally, the side panel 13 is mounted and the panel covering portion 131 of the side panel 13 covers the panel mounting portion 121 of the front panel 12, and then the side panel 13 is pushed downwards or the gravity of the side panel 13 is utilized to snap an upper edge of the snapping slot 1311 of the panel covering portion 131 into the groove 1225 of the panel connecting member 122. Thus, the panel covering portion 131 of the side panel 13 will shield the panel mounting portion 121 of the front panel 12, and the screw and panel connecting member 122 on the panel mounting portion 121, without affecting appearance of the frame structure.

Figure 9:
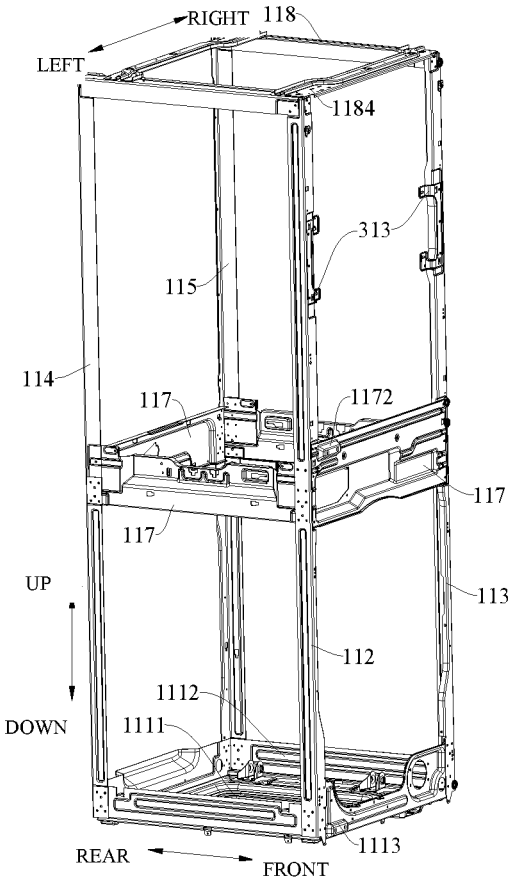
FIG. 9 is an assembly diagram of the support frame illustrated in FIG. 5.
Figure 33:
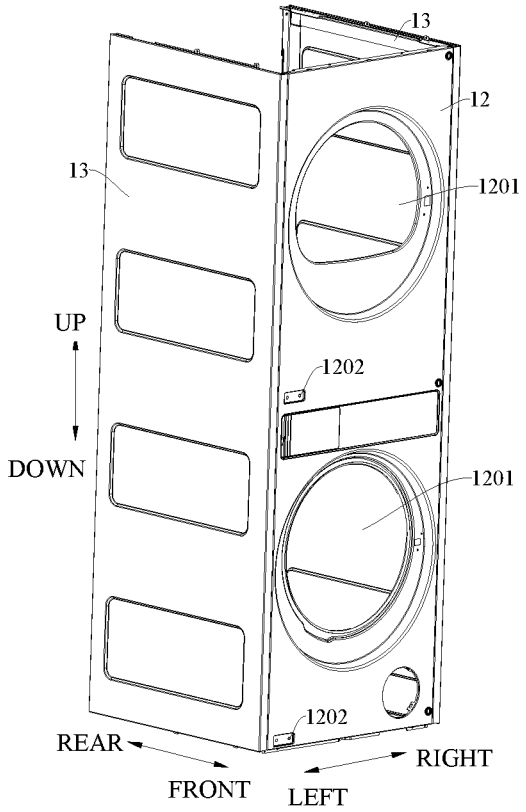
FIG. 33 is an assembly view of a part of a support frame of a laundry processing device according to an embodiment of the present application.
Figure 34:
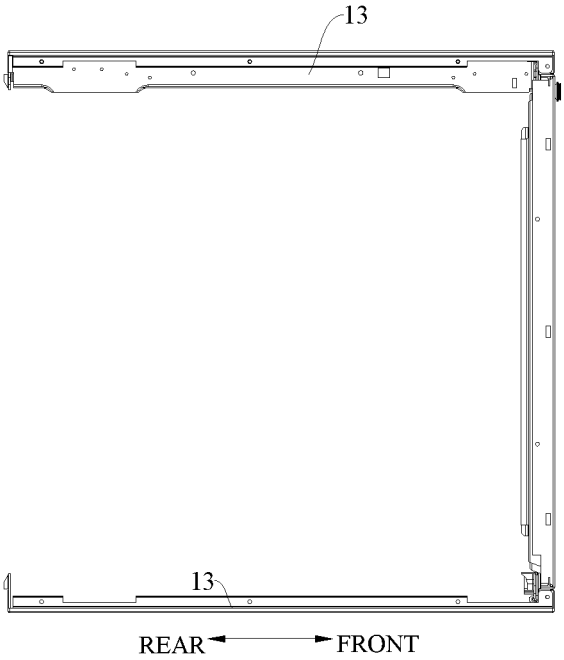
FIG. 34 is a top view of a structure illustrated in FIG. 33.
Figure 35:
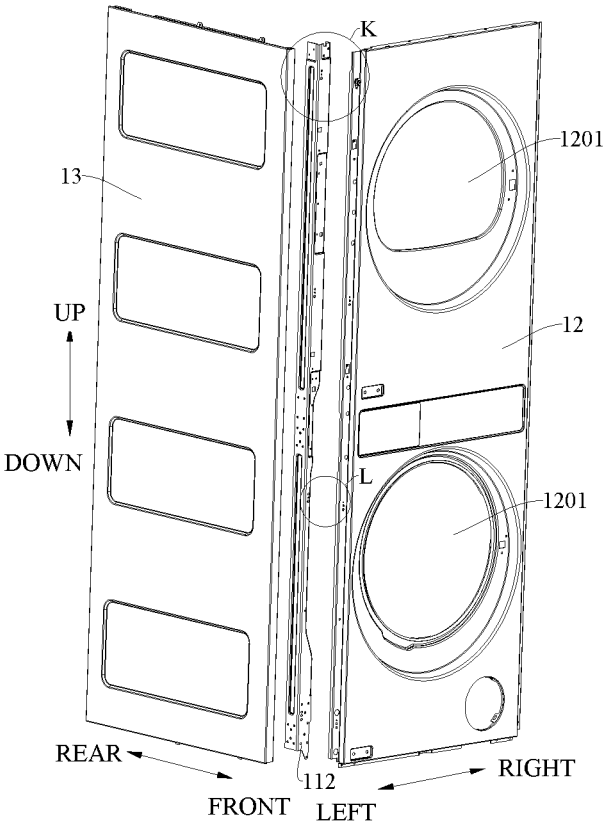
FIG. 35 is another assembly view of a part of a support frame of a laundry processing device according to an embodiment of the present application.
Figure 36:
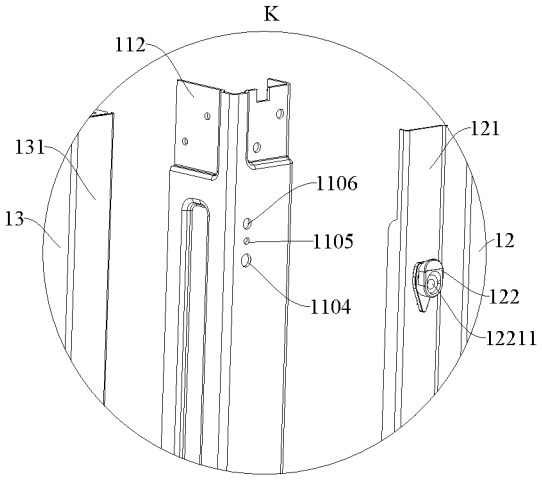
FIG. 36 is an enlarged view of portion K illustrated in FIG. 35.
Figure 37:
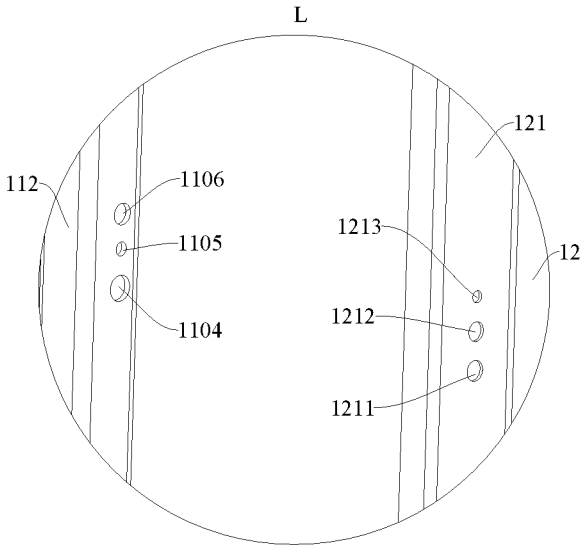
FIG. 37 is an enlarged view of portion L illustrated in FIG. 35.
Figure 38:
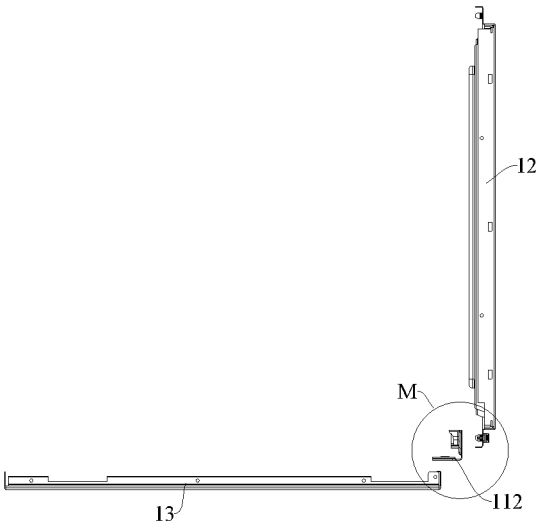
FIG. 38 is a top view of a structure illustrated in FIG. 35.
Figure 39:
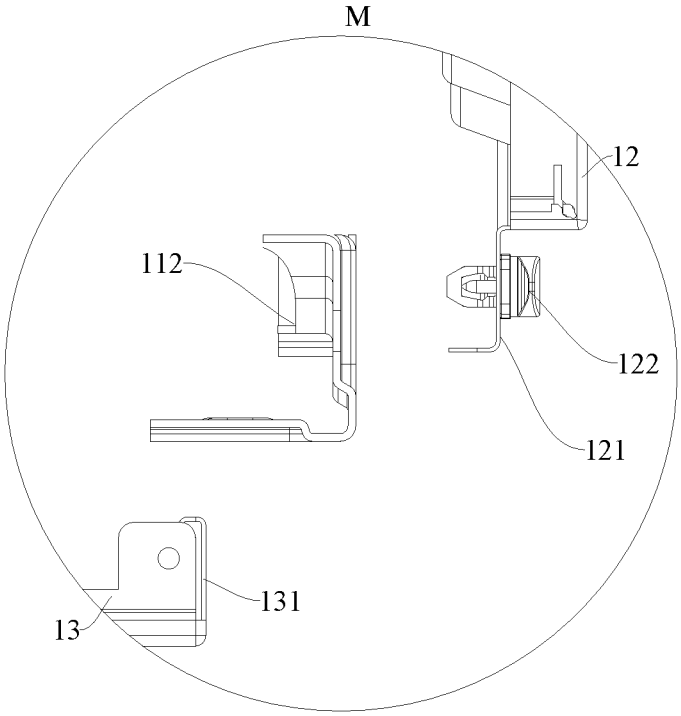
FIG. 39 is an enlarged view of portion M illustrated in FIG. 38.
Figure 40:
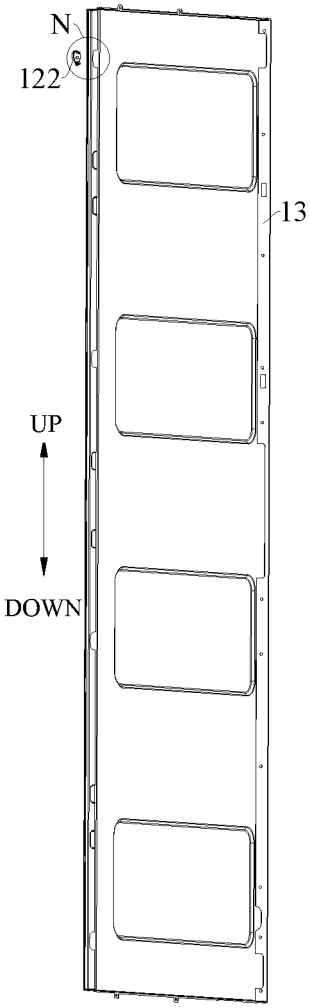
FIG. 40 is a structural schematic view of a side panel and a panel connecting member of a laundry processing device according to an embodiment of the present application.
Figure 41:
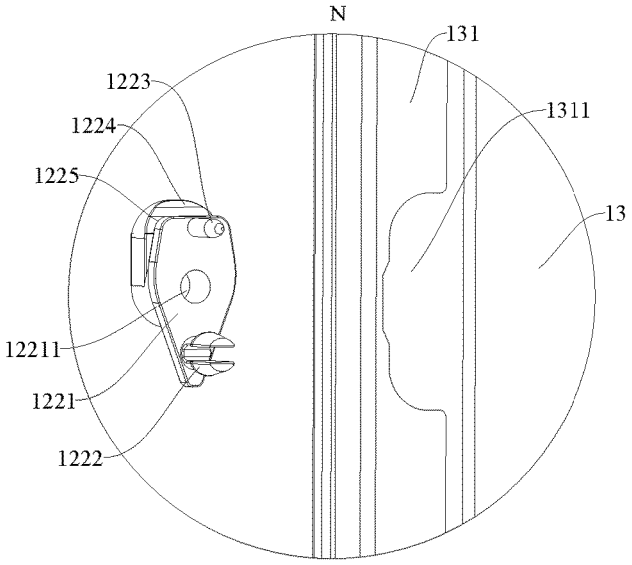
FIG. 41 is an enlarged view of portion N illustrated in FIG. 40.
Figure 42:
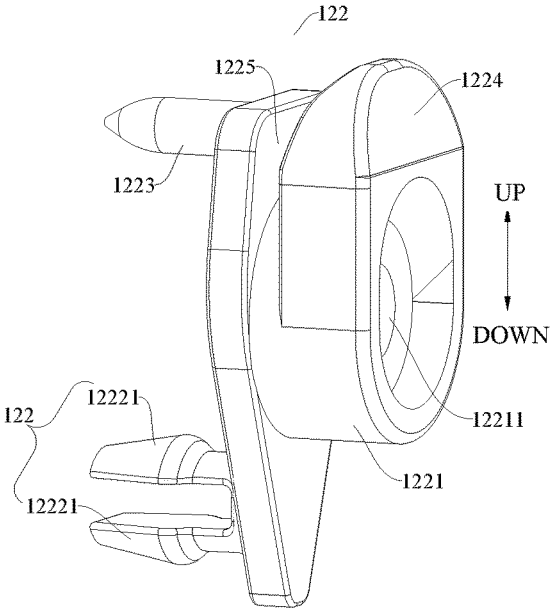
FIG. 42 is a structural schematic view of a panel connecting member of a laundry processing device according to an embodiment of the present application.

As illustrated in FIGS. 9 and 33, a front surface of the connecting cross beam 117 located between the third vertical beam 112 and the fourth vertical beam 113 is provided with a first hinge mounting seat 1172. A front surface of the side enclosure plate 1112 located between the third vertical beam 112 and the fourth vertical beam 113 is provided with a second hinge mounting seat 1113. An upper surface of the top connecting frame 118 is provided with a second hinge mounting seat 1184. Middle portion of the front panel 12 defines a mounting recess 1202. A bottom wall of the mounting recess 1202 defines a mounting hole 3325 corresponding in position to a perforation in the first hinge mounting seat 1172. A lower portion of the front panel 12 also defines a mounting recess 1202, and a bottom wall of this mounting recess 1202 defines a mounting hole 3325 corresponding in position to a perforation in the second hinge mounting seat 1113 (1184).

As illustrated in FIGS. 13 to 17, the door assembly 15 of the laundry processing device 100 includes a first door 151 and a second door 152. The first door 151 is located below the second door 152, and an upper end of the first door 151 and a lower end of the second door 152 are connected to the support frame 11 by an intermediate hinge 153. In one embodiment, the intermediate hinge 153 includes an intermediate mounting portion 1531 and an intermediate connecting portion 1532. The intermediate mounting portion 1531 is disposed in the mounting recess 1202 and is connected to the first hinge mounting seat 1172 by a fastener, to be fixed to the front portion of the support frame 11. The intermediate connecting portion 1532 is connected to the intermediate mounting portion 1531. An upper surface of the intermediate connecting portion 1532 has an upper fixing shaft 1533 extending upwards, and the upper fixing shaft 1533 is fitted with the second door 152. A lower surface of the intermediate connecting portion 1532 has a lower fixing shaft 1534 extending downwards, and the lower fixing shaft 1534 is fitted with the first door 151.

A lower end of the first door 151 is connected to the lower end of the support frame 11 by a first end hinge 154. The first end hinge 154 includes a first end face mounting portion 1541 and a first end face connecting portion 1542. The first end face mounting portion 1541 is provided in the mounting recess 1202 and is connected to the second hinge mounting seat 1113 by a fastener, to be fixed to the lower portion of the support frame 11. The first end face connecting portion 1542 is connected to the first end face mounting portion 1541. The first end face connecting portion 1542 has a lower connecting shaft 1543 extending upwards, and the lower connecting shaft 1543 is fitted with a lower end face of the first door 151.

An upper end of the second door 152 is connected to the upper end of the support frame 11 by a second end hinge 155. The second end hinge 155 includes a second end face mounting portion 1551 and a second end face connecting portion 1552. The second end face mounting portion 1551 is connected to the second hinge mounting seat 1184 on the upper surface of the top connecting frame 118 by a fastener, to be fixed to an upper portion of the support frame 11. The second end face connecting portion 1552 is connected to the second end face mounting portion 1551, the second end face connecting portion 1552 has an upper connecting shaft 1553 extending downwards, and the upper connecting shaft 1553 is fitted with an upper end face of the second door 152.

Figure 13:
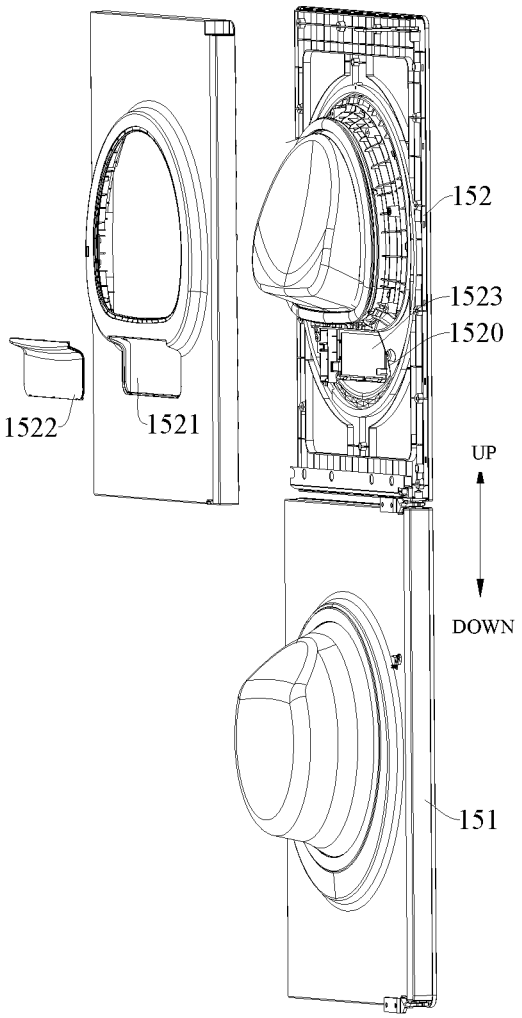
FIG. 13 is an exploded view of a door assembly of a laundry processing device in FIG. 3 according to an embodiment of the present application.
Figure 14:
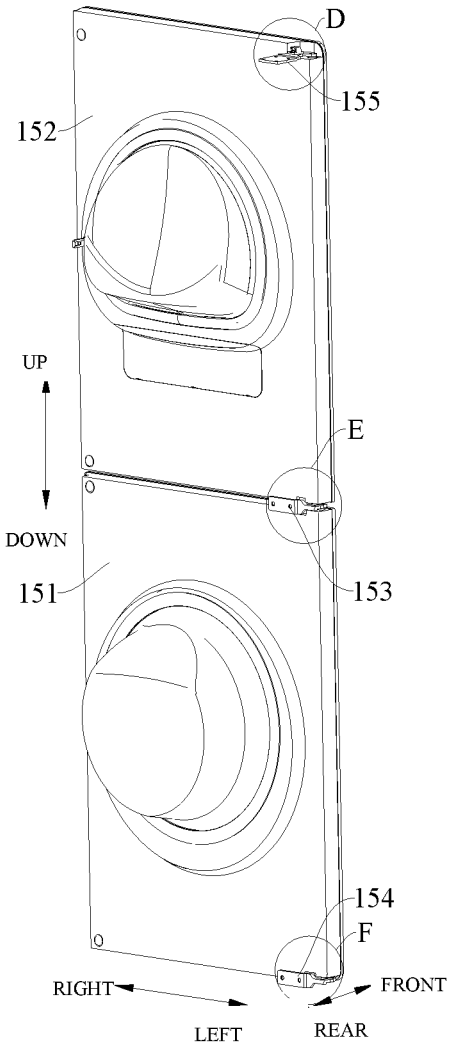
FIG. 14 is a structural schematic view of a door assembly of a laundry processing device in FIG. 3 according to an embodiment of the present application.
Figure 15:
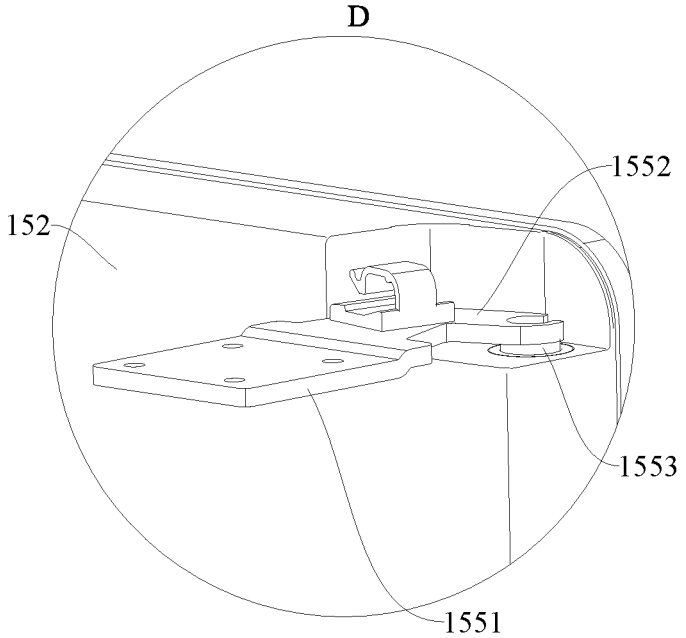
FIG. 15 is an enlarged view of portion D illustrated in FIG. 14.
Figure 16:
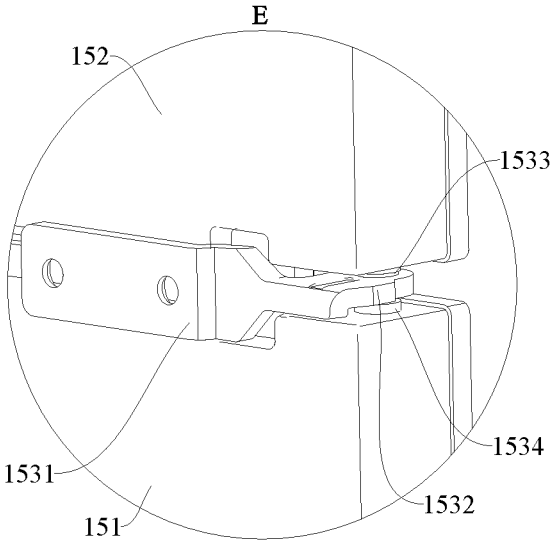
FIG. 16 is an enlarged view of portion E illustrated in FIG. 14.
Figure 17:
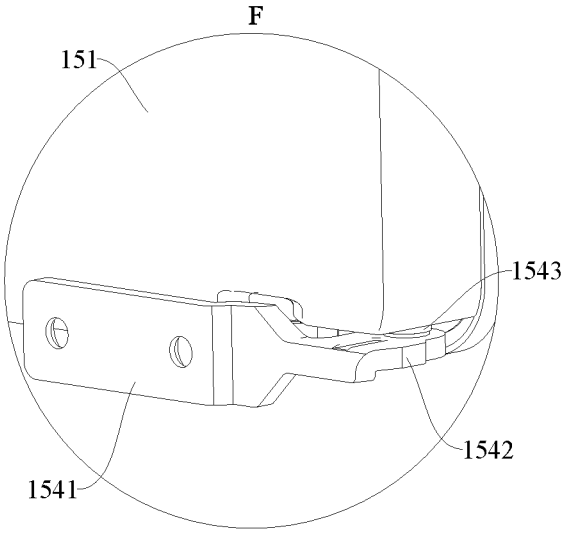
FIG. 17 is an enlarged view of portion F illustrated in FIG. 14.
Figure 18:
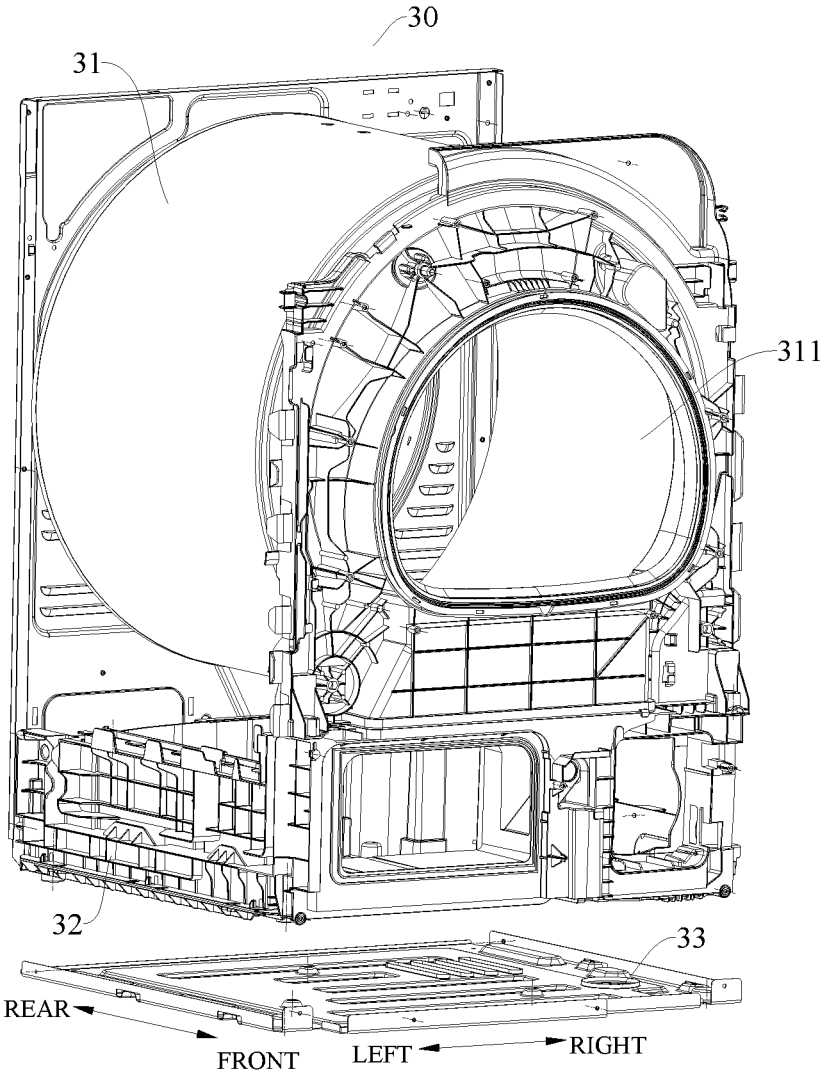
FIG. 18 is a structural schematic view of a drying device of a laundry processing device according to an embodiment of the present application from a perspective.
Figure 19:
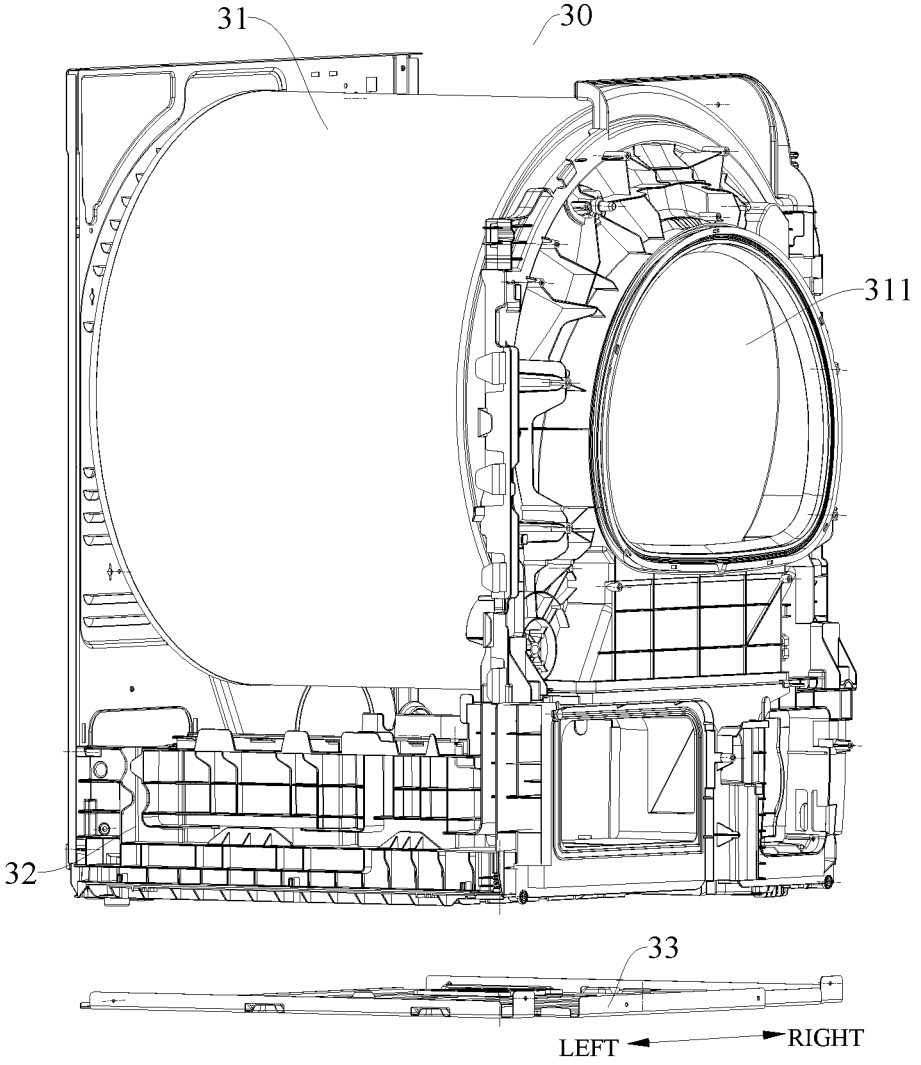
FIG. 19 is a structural schematic view of a drying device of a laundry processing device according to an embodiment of the present application from another perspective.
Figure 20:
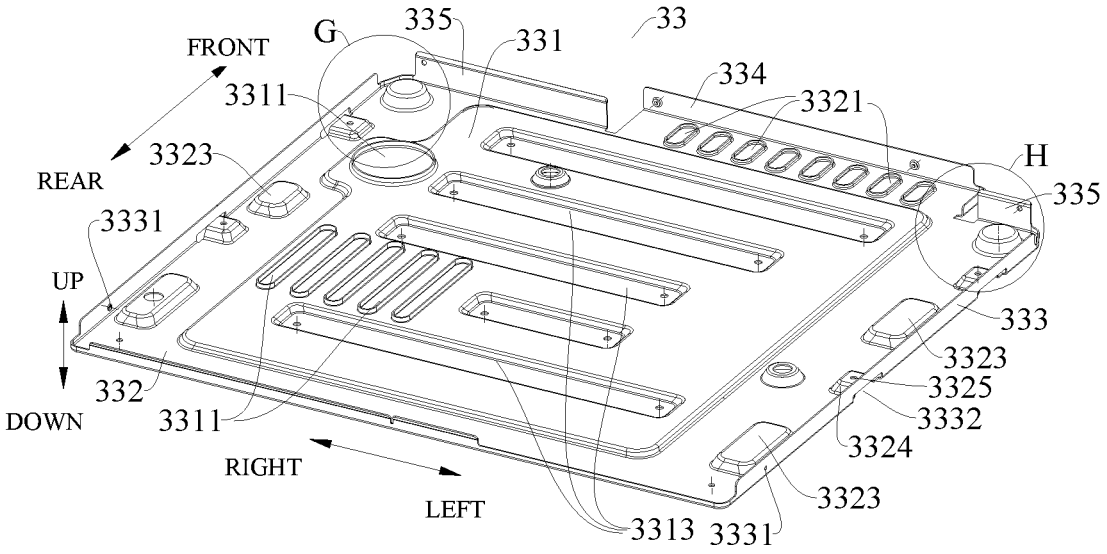
FIG. 20 is a structural schematic view of a reinforcing plate of a laundry processing device according to an embodiment of the present application.
Figure 21:
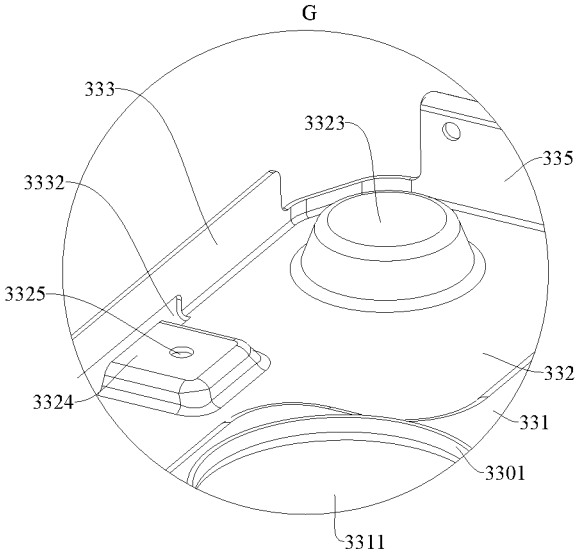
FIG. 21 is an enlarged view of portion G illustrated in FIG. 20.
Figure 22:
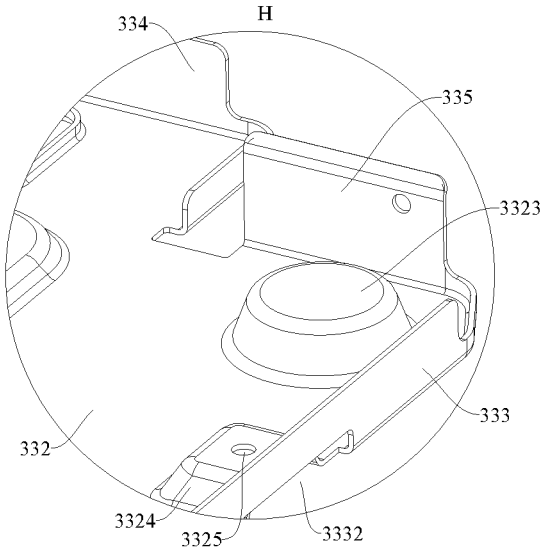
FIG. 22 is an enlarged view of portion H illustrated in FIG. 20.
Figure 23:
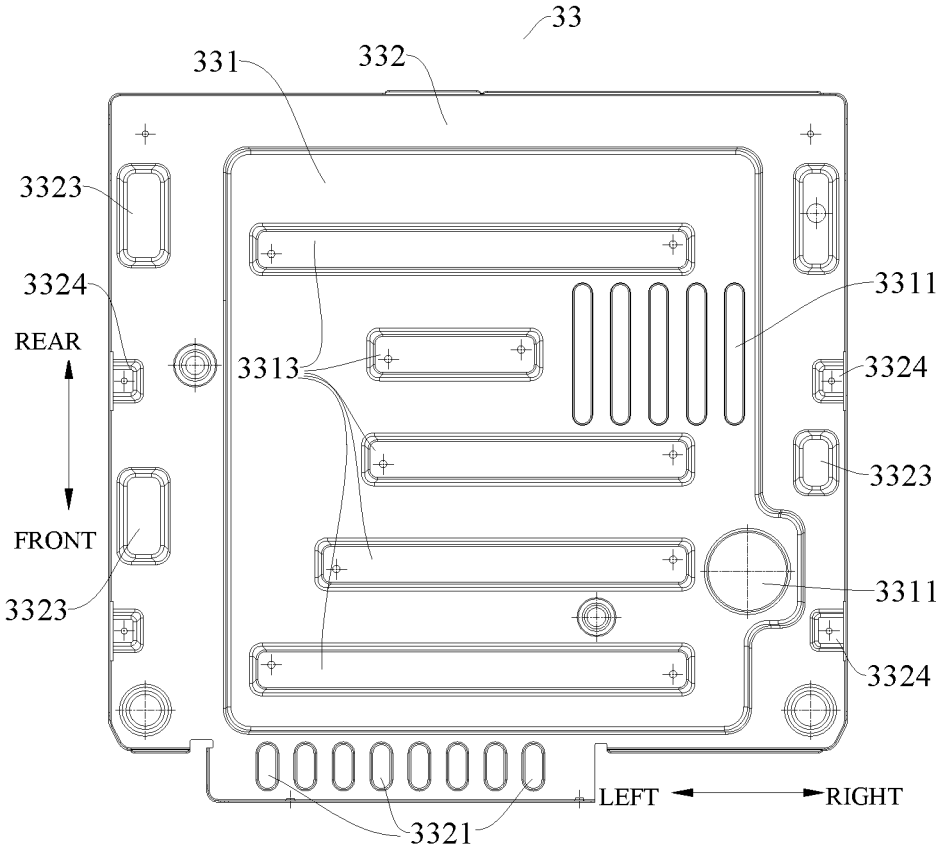
FIG. 23 is a top view of a reinforcing plate illustrated in FIG. 20.
Figure 24:
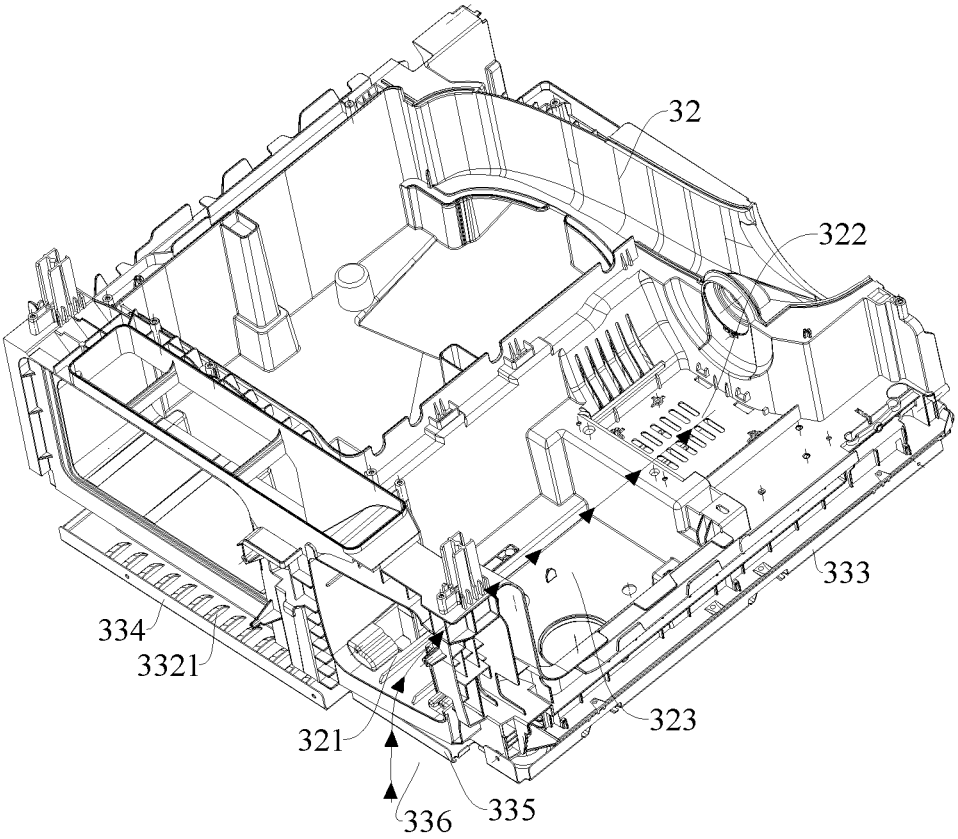
FIG. 24 is an assembly diagram of a reinforcing plate and a seat of a drying unit.
Figure 25:
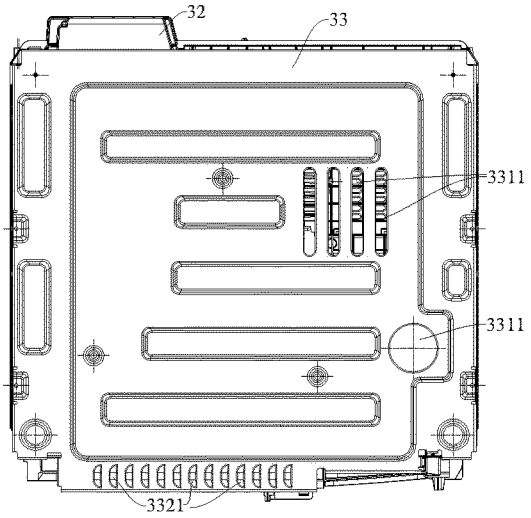
FIG. 25 is a bottom view of a structure illustrated in FIG. 24.
Figure 26:
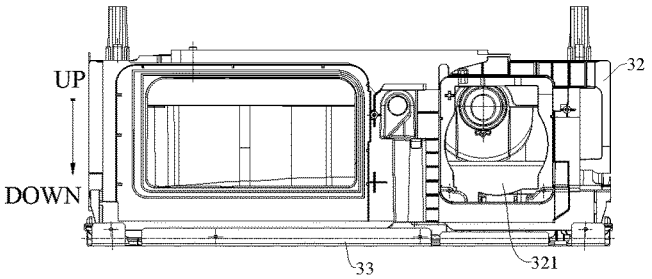
FIG. 26 is a side view of a structure illustrated in FIG. 24.
Figure 27:
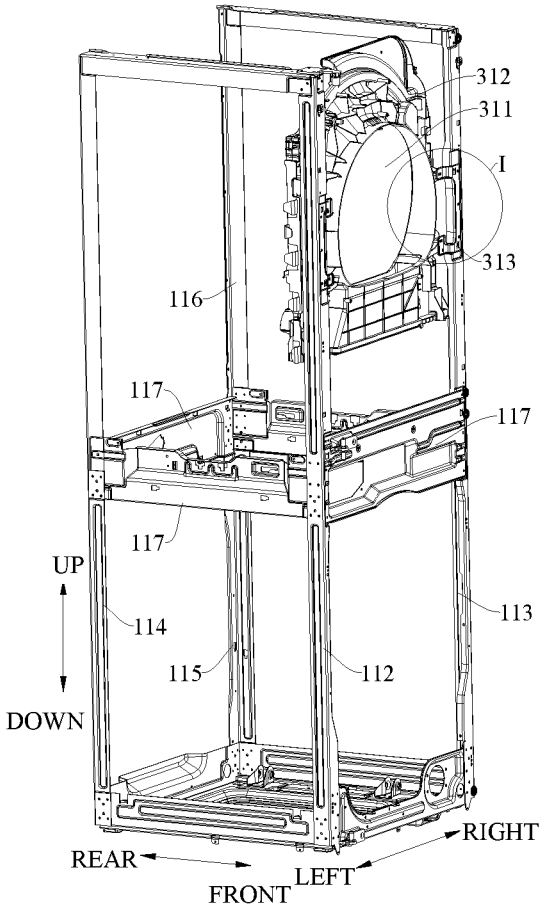
FIG. 27 is an assembly diagram of a support frame and a support structure of a laundry processing device according to an embodiment of the present application.
Figure 28:
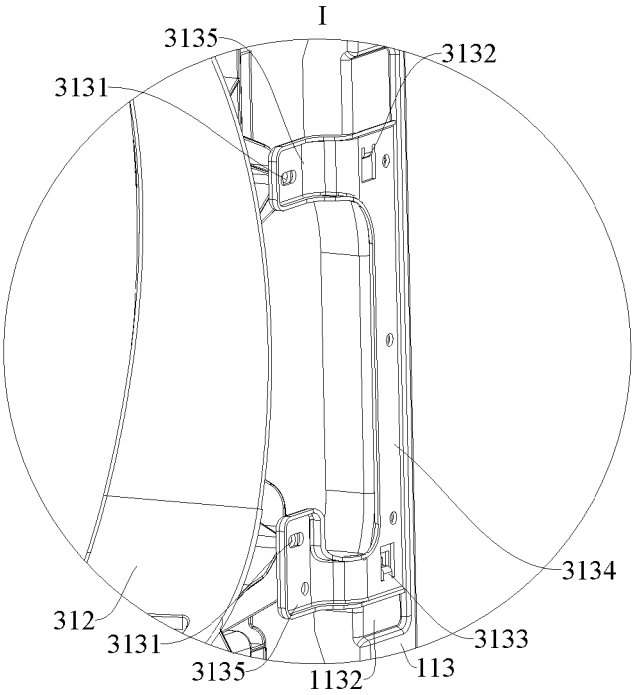
FIG. 28 is an enlarged view of portion I illustrated in FIG. 27.
Figure 29:
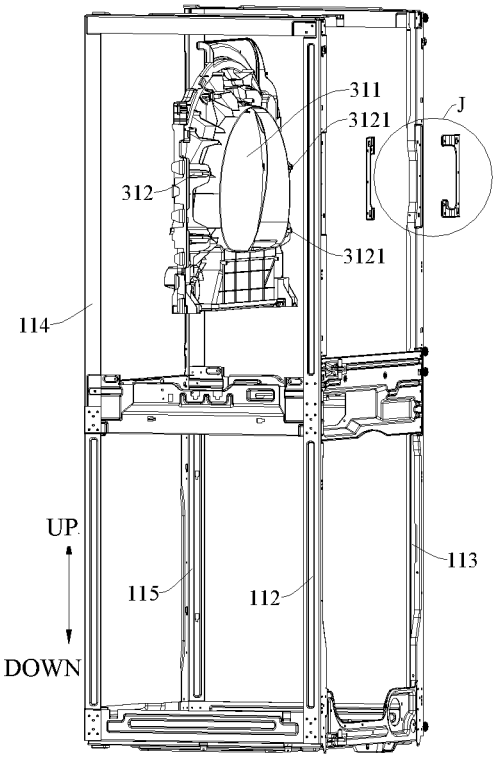
FIG. 29 is an exploded view of a support frame and a support structure of a laundry processing device according to an embodiment of the present application.
Figure 30:
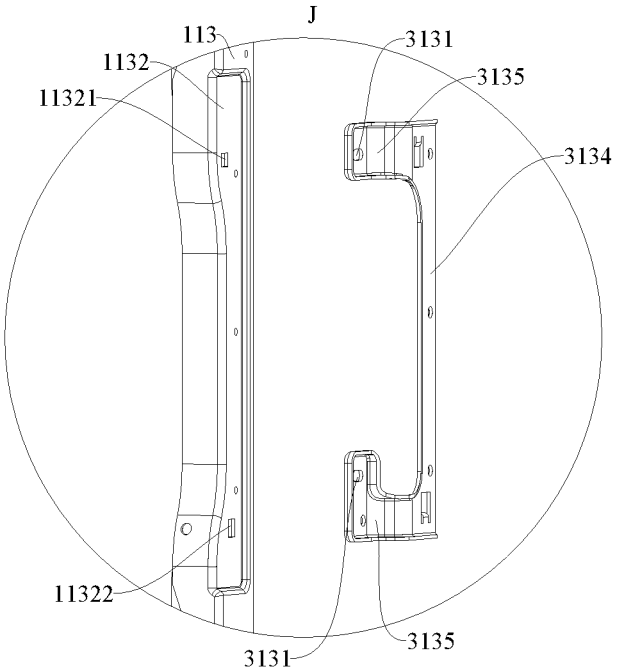
FIG. 30 is an enlarged view of portion J illustrated in FIG. 29.
Figure 31:
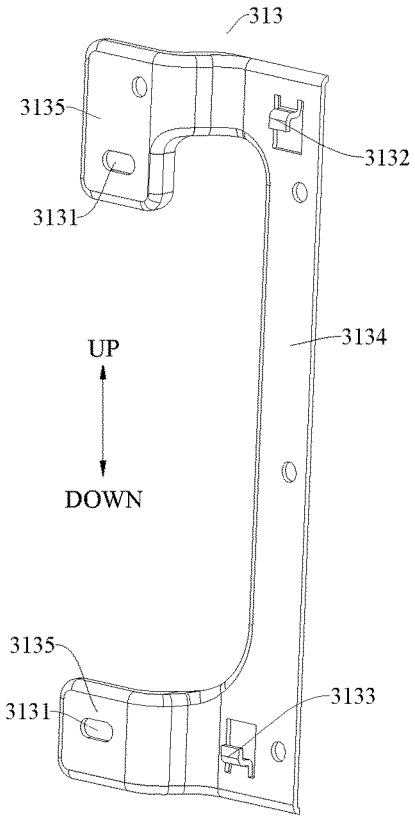
FIG. 31 is a structural schematic view of a frame connecting member of a laundry processing device according to an embodiment of the present application.
Figure 32:
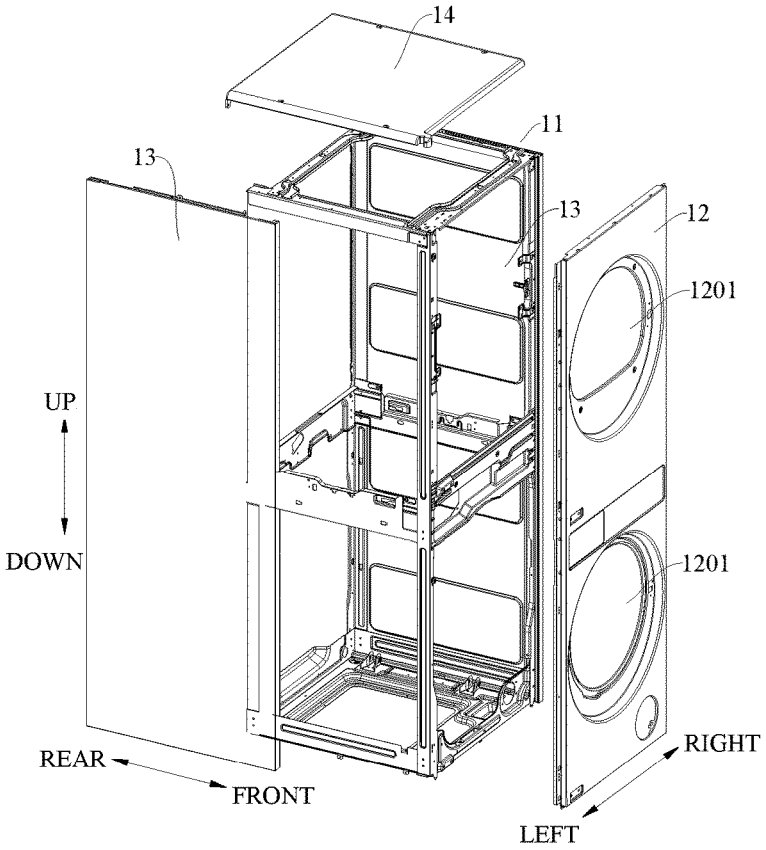
FIG. 32 is an exploded view of a support frame of a laundry processing device according to an embodiment of the present application.

As illustrated in FIG. 13, an inward side of the second door 152 defines a mounting opening 1521, a control panel 1523 is mounted in a mounting cavity 1520 of the second door 152 via the mounting opening 1521, and a cover plate 1522 is adapted to detachably close the mounting opening 1521, and the control panel 1523 is closed in the mounting cavity 1520 of the second door 152.

The first laundry processing device 20 includes a first laundry processing tub 21. The first laundry processing device 20 may be a washing device and is mounted in the first accommodating space 1101 located in the lower portion. The second laundry processing device 30 includes a second laundry processing tub 31. The second laundry processing device 30 may be a drying device and is mounted in a second accommodating space 1102 located at the upper portion. The drying device is provided with a control board in communication with the control panel 1523. The operational environment of the drying device has relatively low moisture, and will not cause damage to the control board.

As illustrated in FIGS. 18 to 26, the drying device includes a drying unit and a reinforcing plate 33 provided below a seat 32 of the drying unit. The drying device is connected to the support frame 11 by the reinforcing plate 33 pre-mounted on the drying unit, and a gap is defined between the seat 32 and the front panel 12.

The seat 32 of the drying unit includes a suction area 321 for mounting a cooling fan, a blower mounting cavity 322 and a heat pump mounting cavity 323. The reinforcing plate 33 defines first vent holes 3311 in communication with the blower mounting cavity 322, second vent holes 3321 and an avoidance notch 336 corresponding in position to the suction area 321. A peripheral edge of the reinforcing plate 33 is provided with a first mounting flange 334 bent upwards, for connecting with the connecting cross beam 117. The peripheral edge of the reinforcing plate 33 is further provided with a second mounting flange 335 bent upwards and located at an inner side of the first mounting flange 334, for connecting with the seat 32 of the drying unit.

The reinforcing plate 33 is substantially formed into a square plate member and includes a first plate portion 331 and a second plate portion 332 which is recessed relative to the first plate portion 331 and surrounds the first plate portion 331. A front portion of the second plate portion 332 forms an extension portion beyond the peripheral edge of the seat 32. The plurality of second vent holes 3321 are defined in the extension portion. Reinforcing recesses 3313 are defined in the first plate portion 331 and spaced apart in the front-and-rear direction. Each reinforcing recess 3313 extends in a left-and-right direction. Reinforcing protrusions 3323 are provided to the second plate portion 332 and spaced apart in a circumferential direction of the first plate portion 331. The peripheral edge of the reinforcing plate 33 is further provided with a fixing flange 333 bent upwards. The fixing flange 333 defines a fixing hole 3331. The fixing flange 333 further defines an insertion hole 3332 through its thickness direction. The reinforcing plate 33 is provided with a mounting boss 3324 close to the position of the insertion hole 3332, and the top of the mounting boss 3324 defines a mounting hole 3325. For example, the support structure 312 has an insertion portion adapted to be inserted into the insertion hole 3332, to connect the mounting boss 3324.

During the operation of the drying device, part of air located in the washing device flows into the suction area 321 through the avoidance notch 336 and a gap between the suction area 321 and the front panel 12, for cooling the heat pump system. Furthermore, air between the drying device and the washing device can also achieve circulation through the plurality of second vent holes 3321.

As illustrated in FIGS. 27 to 31, the drying unit includes a drying tub and support structures 312 provided to a front end and a rear end of the drying tub. The support structure 312 located at the front end of the drying tub is connected to the third vertical beam 112 and the fourth vertical beam 113 by two frame connecting members 313.

The frame connecting member 313 includes a connecting body 3134 and two connecting arms 3135. The connecting body 3134 extends in a length direction of the third vertical beam 112 or the fourth vertical beam 113. The two connecting arms 3135 are connected to two ends of the connecting body 3134 and extend towards the support structure 312. The connecting arms 3135 are recessed inwards towards the second accommodating space 1102 relative to the connecting body 3134. Each connecting arm 3135 defines a first connecting hole 3131. The connecting body 3134 is provided with a first fixing protrusion 3132 and a second fixing protrusion 3133 that are bent towards the third vertical beam 112 or the fourth vertical beam 113.

The support structure 312 defines a second connecting hole 3121 corresponding in portion to the first connecting hole 3131, and the frame connecting member 313 and the support structure 312 are connected by a fastener passing through the first connecting hole 3131 and the second connecting hole 3121.

A front side surface of each of the third vertical beam 112 and the fourth vertical beam 113 defines a recessed second accommodating recess 1132. A bottom wall of the second accommodating recess 1132 in the third vertical beam 112 defines a first fixing perforation 11321, and a bottom wall of the second accommodating recess 1132 in the fourth vertical beam 113 defines a first fixing perforation 11321. The frame connecting member 313 is provided in the second accommodating recess 1132. The first fixing protrusion 3132 of the frame connecting member 313 provided on the third vertical beam 112 is fitted in the first fixing perforation 11321 and the second fixing protrusion 3133 thereof is fitted in the second fixing perforation 11322, to achieve connection of the third vertical beam 112 and the frame connecting member 313. The first fixing protrusion 3132 of the frame connecting member 313 provided on fourth vertical beam 113 is fitted in the first fixing perforation 11321, and the second fixing protrusion 3133 thereof is fitted in the second fixing perforation 11322, to achieve connection of the fourth vertical beam 113 and the frame connecting member 313.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "axial," "radial" and "circumferential" should be construed to refer to the orientation as then described or as shown in the drawings under discussion. These relative terms are for convenience of description and do not require that the present disclosure be constructed or operated in a particular orientation.

Other constitutions and operations of the air conditioner 100 according to embodiments of the present application are well known in the art, which will not be described in detail herein.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present application. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A support frame, comprising:

a base; and a plurality of vertical beams extending upwards from the base, at least one of the plurality of vertical beams being formed by detachably connecting at least two sub-units, the at least two sub-units including a lower vertical beam extending upwards from the base, and an upper vertical beam extending upwards from the lower vertical beam, a lower end of the upper vertical beam being provided with a vertical beam connecting sheet extending downwards, and the vertical beam connecting sheet being connected to an upper end of the lower vertical beam by a fastener.

2. The support frame according to claim 1, wherein the base is formed into a square base, and four vertical beams of the plurality of vertical beams are formed to extend from four corners of the square base.

3. The support frame according to claim 2, wherein two corners located at a side of the square base are provided with a first vertical beam and a second vertical beam of the four vertical beams, respectively, and the first vertical beam and/or the second vertical beam are formed by detachably connecting at least two sub-units.

4. The support frame according to claim 3, wherein the first vertical beam is formed by detachably connecting two sub-units, wherein the two sub-units of the first vertical beam are a first lower vertical beam extending upwards from the square base and a first upper vertical beam extending upwards from the first lower vertical beam, and the first upper vertical beam has a lower end detachably connected to an upper end of the first lower vertical beam.

5. The support frame according to claim 4, wherein the second vertical beam is formed by detachably connecting two sub-units, wherein the two sub-units of the second vertical beam are a second lower vertical beam extending upwards from the square base and a second upper vertical beam extending upwards from the second lower vertical beam, and the second upper vertical beam has a lower end detachably connected to an upper end of the second lower vertical beam.

6. The support frame according to claim 5, wherein the lower end of each of the first upper vertical beam and the second upper vertical beam is provided with the vertical beam connecting sheet extending downwards, wherein the vertical beam connecting sheet of the first upper vertical beam is connected to the upper end of the first lower vertical beam by a first fastener, and the vertical beam connecting sheet of the second upper vertical beam is connected to the upper end of the second lower vertical beam by a second fastener.

7. The support frame according to claim 6, wherein the vertical beam connecting sheet is bent outwards and extends downwards relative to the first upper vertical beam or the second upper vertical beam, wherein at least part of an outer side of the upper end of the first lower vertical beam or the second lower vertical beam is covered by the vertical beam connecting sheet.

8. The support frame according to claim 2, wherein the square base has a bottom plate and four side enclosure plates connected to sides of the bottom plate, and lower ends of two adjacent vertical beams are connected by the side enclosure plate.

9. The support frame according to claim 2, further comprising a plurality of connecting cross beams, middle portions of two adjacent vertical beams are connected by the connecting cross beam.

10. The support frame according to claim 9, wherein two corners located at another side of the square base are provided with a third vertical beam and a fourth vertical beam of the four vertical beams, respectively, middle portions of outer surfaces of the third vertical beam and the fourth vertical beam each define a recessed first accommodating recess, and two ends of at least one connecting cross beam are disposed in the recessed first accommodating recesses of the third vertical beam and the fourth vertical beam respectively.

11. The support frame according to claim 10, wherein a bottom wall of the recessed first accommodating recess defines a snapping hole, the two ends of the connecting cross beam are each provided with a snapping tongue bent towards the third vertical beam, and the snapping tongue is inserted downward into the snapping hole.

12. The support frame according to claim 3, further comprising:

a top connecting frame connected to an upper end of a vertical beam, wherein at least part of the top connecting frame and one sub-unit of the vertical beam are integrally formed from a same plate using a bending forming process.

13. The support frame according to claim 12, wherein the at least part of the top connecting frame is formed by bending one sub-unit of the first vertical beam and/or the second vertical beam.

14. The support frame according to claim 12, wherein two corners located at another side of the square base are provided with a third vertical beam and a fourth vertical beam of the four vertical beams, respectively, an upper end of at least one of the third vertical beam and the fourth vertical beam defines a notch recessed downwards, the top connecting frame has an insertion sheet bent outwards, and the insertion sheet is inserted in the notch.

15. The support frame according to claim 14, wherein the upper end of at least one of the third vertical beam and the fourth vertical beam has a first connecting sheet and a second connecting sheet arranged at a preset angle, and the top connecting frame has a first connecting flange and a second connecting flange extending downwards and arranged at a preset angle, wherein the first connecting flange and the second connecting flange are spaced apart, the first connecting sheet is disposed at an outer side of the first connecting flange, and the second connecting sheet is inserted through a gap between the first connecting flange and the second connecting flange to be disposed at an inner side of the second connecting flange.

16. The support frame according to claim 15, wherein the notch is defined in the first connecting sheet, and the insertion sheet is provided to the first connecting flange.

17. The support frame according to claim 15, wherein the first connecting sheet defines a first perforation, and the first connecting flange defines a first through hole corresponding in position to the first perforation, wherein the first connecting sheet and the first connecting flange are connected by a fastener passing through the first perforation and the first through hole.

18. The support frame according to claim 15, wherein the second connecting sheet defines a second perforation, and the second connecting flange defines a second through hole corresponding in position to the second perforation, wherein the second connecting sheet and the second connecting flange are connected by a fastener passing through the second perforation and the second through hole.

19. A laundry processing device, comprising:

a first laundry processing device, a second laundry processing device and a support frame, comprising:

a base; and a plurality of vertical beams extending upwards from the base, at lease one of the plurality of vertical beams being formed by detachably connecting at least two sub-units, the at least two sub-units including a lower vertical beam extending upwards from the base, and an upper vertical beam extending upwards from the lower vertical beam, a lower end of the upper vertical beam being provided with a vertical beam connecting sheet extending downwards, and the vertical beam connecting sheet being connected to an upper end of the lower vertical beam by a fastener;

wherein the support frame defines therein a first accommodating space for assembly of the first laundry processing device and a second accommodating space for assembly of the second laundry processing device.

* * * * *